US010494870B2

(12) United States Patent
Hanback

(10) Patent No.: US 10,494,870 B2
(45) **Date of Patent: *Dec. 3, 2019**

(54) ADVANCED DRILLING SYSTEMS AND METHODS

(71) Applicant: John Hanback, Flint Hill, VA (US)

(72) Inventor: John Hanback, Flint Hill, VA (US)

(73) Assignee: John Hanback, Flint Hill, VA (US)

( * ) Notice: Subject to any disclaimer, the term of this patent is extended or adjusted under 35 U.S.C. 154(b) by 23 days.

This patent is subject to a terminal disclaimer.

(21) Appl. No.: 15/875,455

(22) Filed: Jan. 19, 2018

(65) Prior Publication Data

US 2018/0209218 A1 Jul. 26, 2018

Related U.S. Application Data

(63) Continuation of application No. 14/578,092, filed on Dec. 19, 2014, now Pat. No. 9,890,594.

(60) Provisional application No. 61/918,147, filed on Dec. 19, 2013, provisional application No. 61/927,987, filed on Jan. 16, 2014, provisional application No. 61/984,887, filed on Apr. 28, 2014, provisional application No. 62/005,993, filed on May 30, 2014.

(51) Int. Cl.
*E21B 7/15* (2006.01)

(52) U.S. Cl.
CPC ..... *E21B 7/15* (2013.01)

(58) Field of Classification Search
CPC ..... E21B 7/15
See application file for complete search history.

(56) References Cited

U.S. PATENT DOCUMENTS

| | | | | |
|---|---|---|---|---|
| 4,090,572 | A | 5/1978 | Welch | |
| 2003/0000741 | A1 | 1/2003 | Rosa | |
| 2005/0269132 | A1 | 12/2005 | Batarseh | |
| 2010/0252324 | A1 | 10/2010 | Woskov et al. | |
| 2011/0205652 | A1* | 8/2011 | Abbasi | E21B 7/14 359/896 |
| 2011/0278270 | A1 | 11/2011 | Braga et al. | |
| 2013/0233545 | A1 | 9/2013 | Mahoney et al. | |
| 2014/0041940 | A1 | 2/2014 | Shnell | |
| 2014/0158425 | A1 | 6/2014 | Bozso et al. | |
| 2014/0305635 | A1 | 10/2014 | Linetskiy et al. | |
| 2015/0042145 | A1 | 2/2015 | Grotendorst | |

* cited by examiner

*Primary Examiner* — Kipp C Wallace
(74) *Attorney, Agent, or Firm* — McGuireWoods LLP

(57) ABSTRACT

New systems and methods capable system for drilling are disclosed. An example system can include a vertically-moving platform supporting a gyrotron capable of transmitted electromagnetic energy down a waveguide such that, as the vertically-moving platform moves downward, energy transmitted by the gyrotron through the waveguide will progressively drill a borehole in the earth.

16 Claims, 28 Drawing Sheets

(PLAN VIEW)

(PLAN VIEW)

ADVANCED DRILLING SYSTEMS AND METHODS

CROSS-REFERENCE TO RELATED APPLICATIONS

This is a continuation application of copending U.S. patent application Ser. No. 14/578,092, filed Dec. 19, 2014 which claims priority to the following: (1) U.S. Provisional Application 62/005,993 entitled "Advanced Geothermal Systems and Methods" filed May 30, 2014; (2) U.S. Provisional Application 61/984,887 entitled "Advanced Drilling Systems and Methods" filed Apr. 28, 2014; (3) U.S. Provisional Application 61/927,987 entitled "Advanced Drilling Systems and Methods" filed on Jan. 16, 2014; and (4) U.S. Provisional Application 61/918,147 entitled Geothermal Energy Extraction Systems and Methods" filed on Dec. 19, 2013. The content of each and every document listed above is incorporated herein by reference in its entirety.

BACKGROUND

Converting geothermal energy to electric form has traditionally been a marginally economic and inefficient endeavor. However, by developing new drilling techniques capable of reaching unprecedented depths, new and highly-efficient geothermal facilities can be created. The same deep-drilling techniques can also be used for other purposes.

BRIEF DESCRIPTION OF THE DRAWINGS

Various embodiments of this disclosure that are proposed as examples will be described in detail with reference to the following figures, wherein like numerals reference like elements, and wherein:

FIGS. IA-IK depict a drilling system that, when used according to a sequence, can perform a new drilling process.

FIGS. IL, IM, IN and IP depict details of an interaction between a clamping device and waveguide sections.

Figure 2:
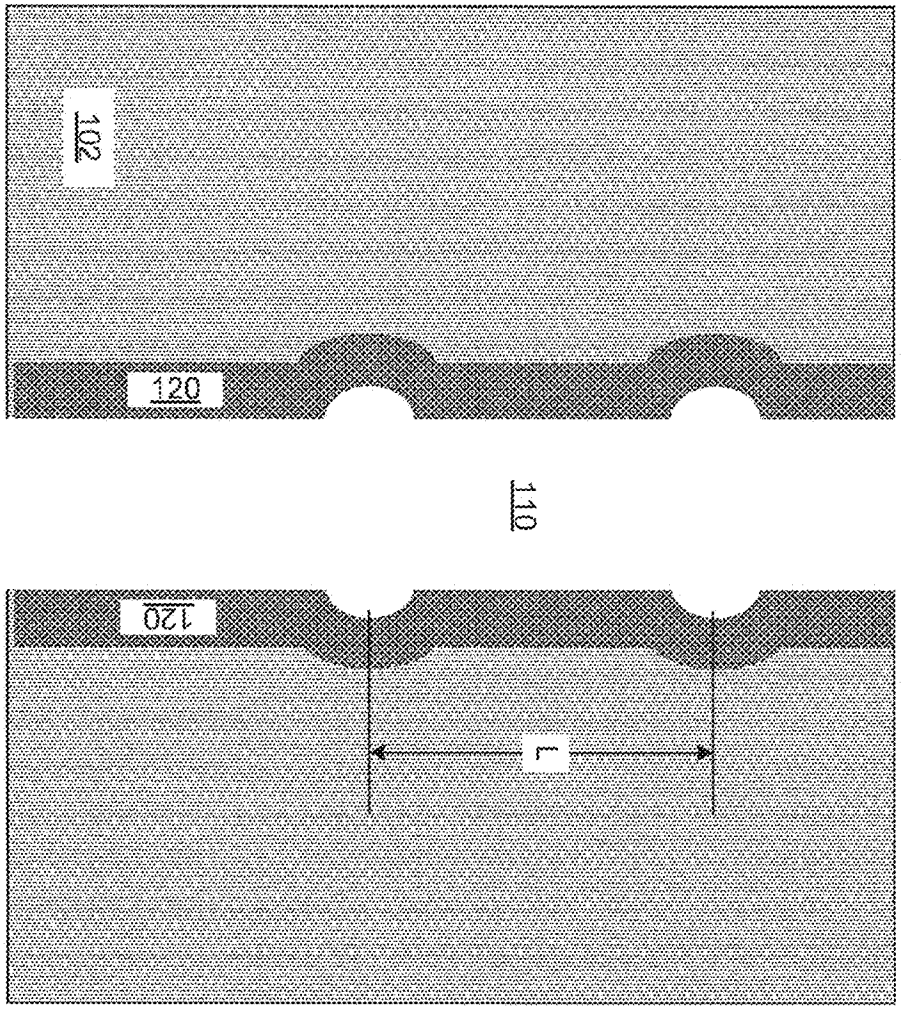

FIG. 2 depicts details of a vertical borehole usable to better secure a pressure vessel inserted therein.

Figure 2B:
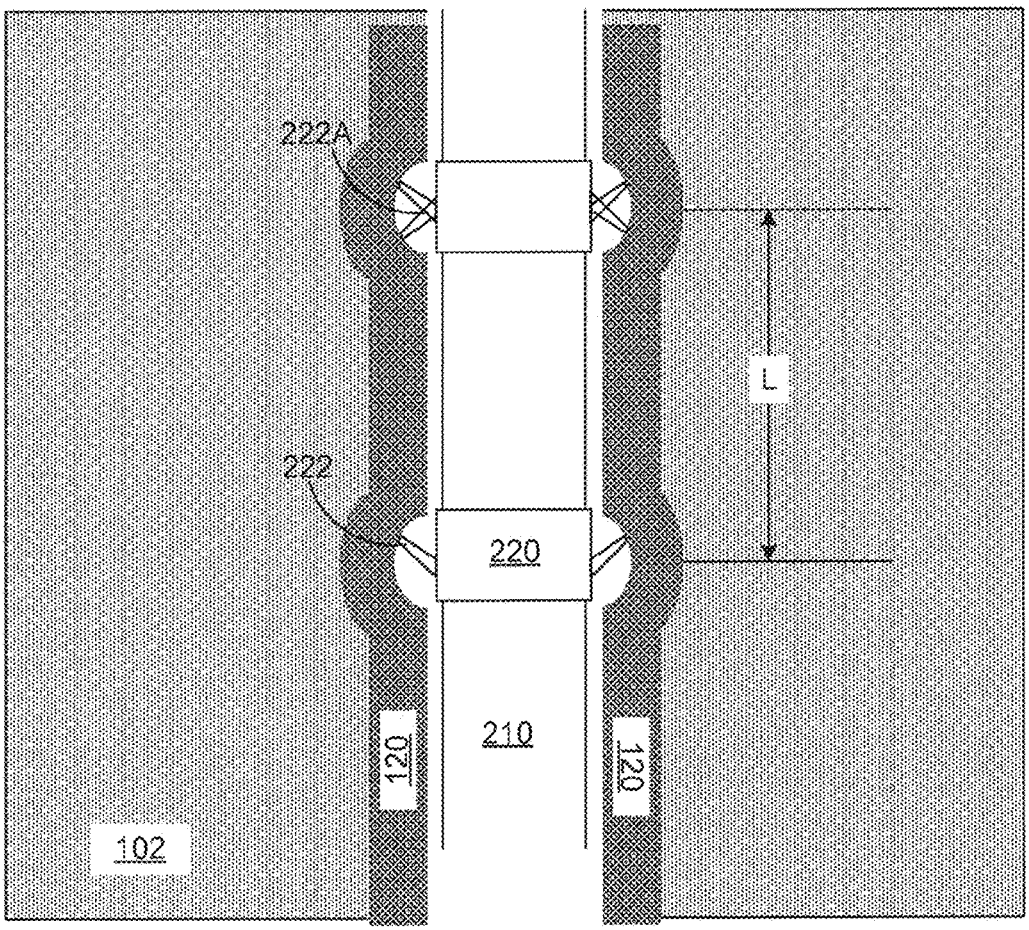

FIG. 2B depicts the vertical borehole of FIG. 2 with a pressure vessel installed therein.

Figure 3:
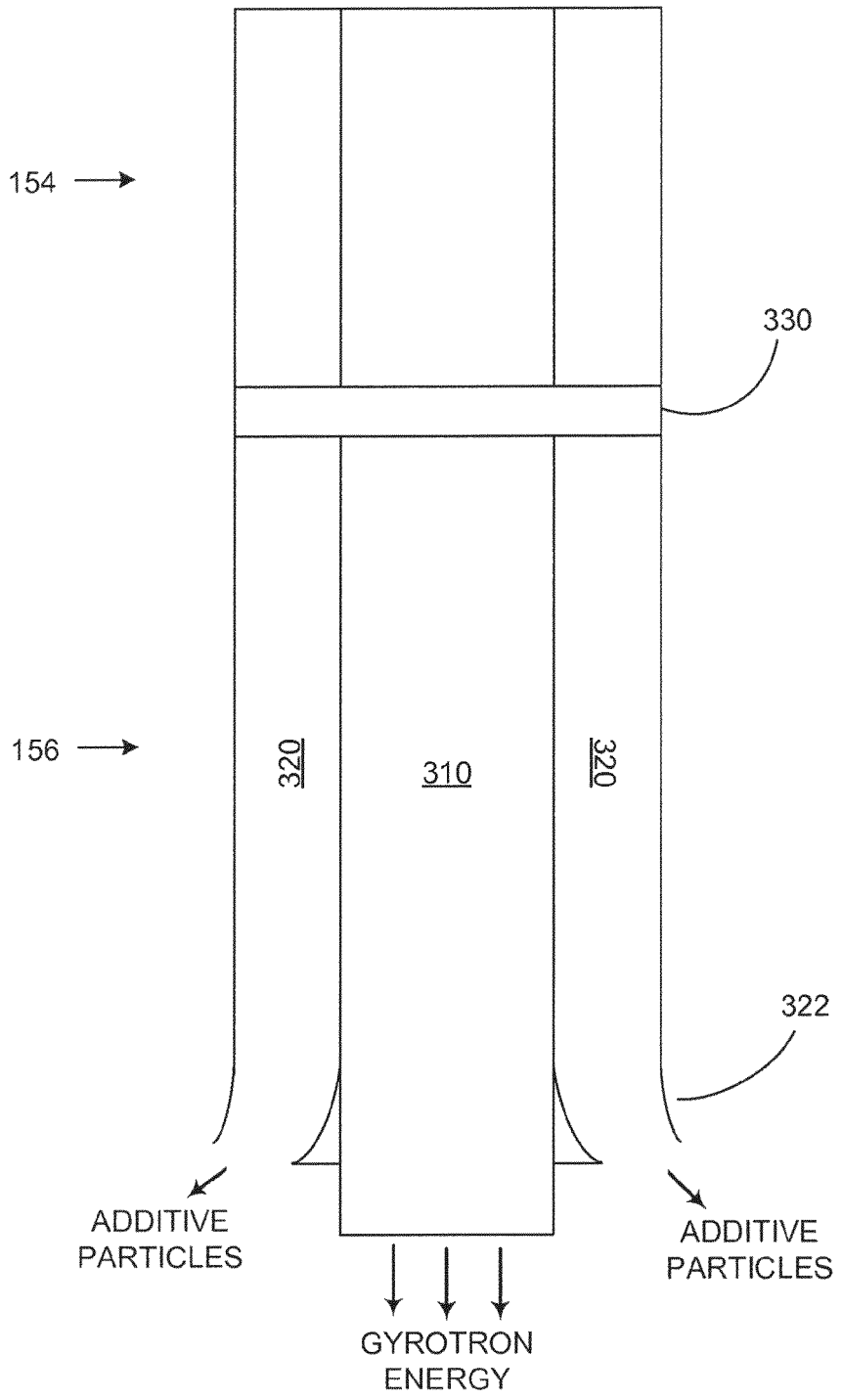

FIG. 3 is a side sectional view of a portion of waveguide sections usable in the drilling system of FIGS. IA-IP.

Figure 3B:
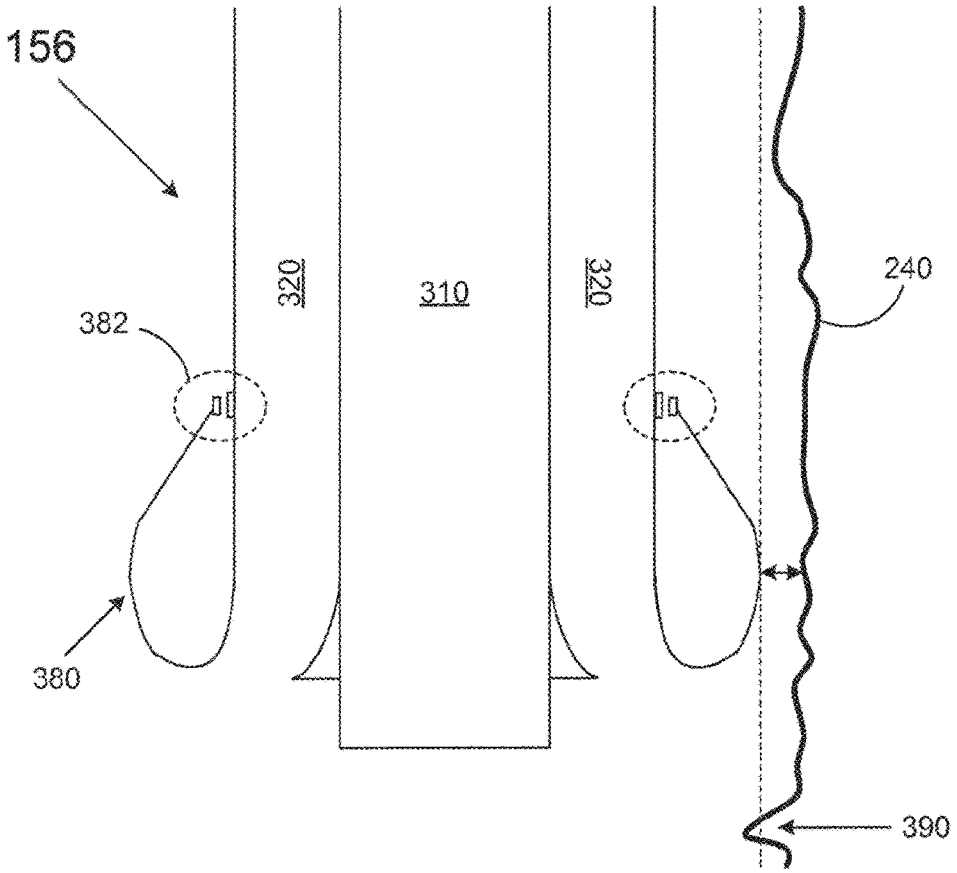

FIG. 3B is an alternative embodiment of the portion of waveguide section of FIG. 3.

Figure 4:
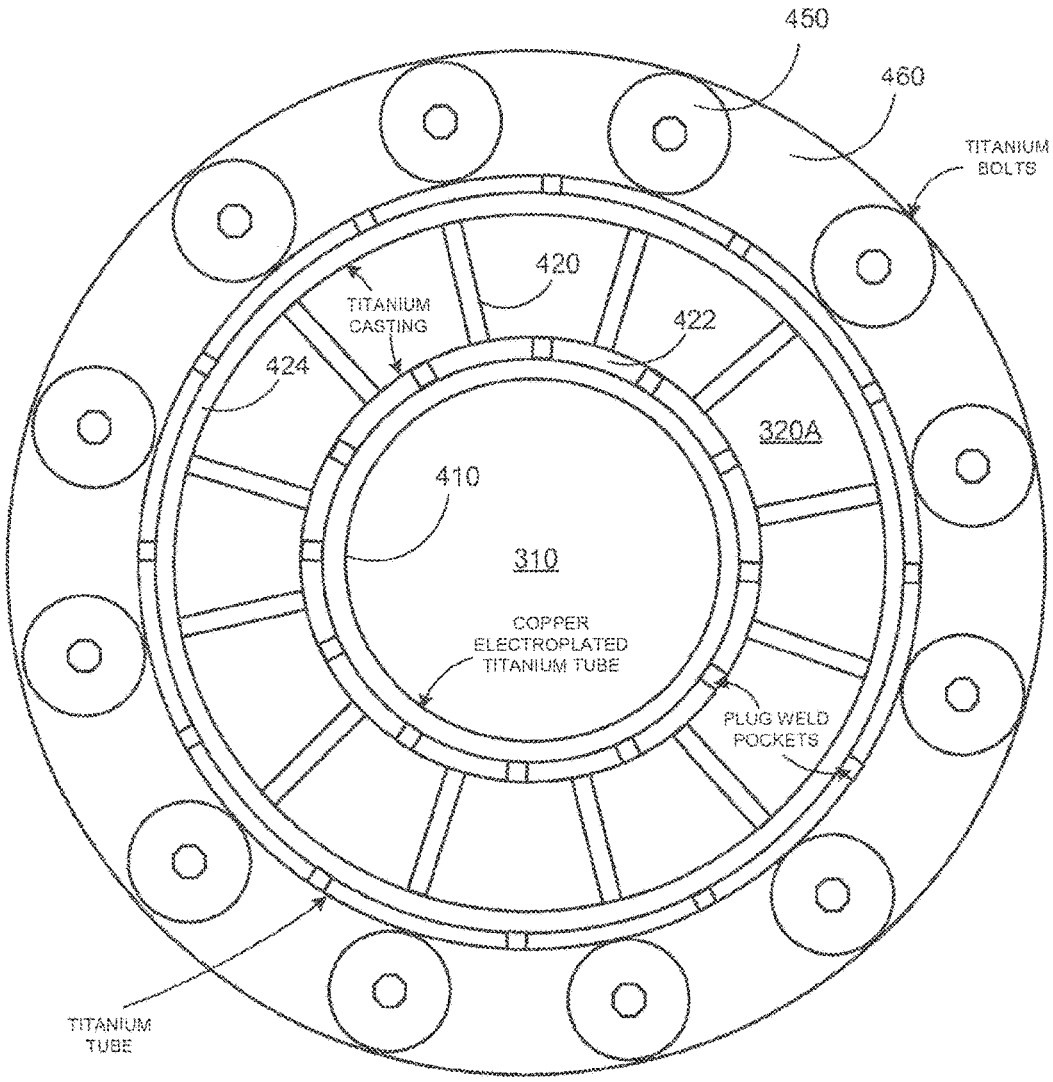

FIG. 4 is a plan view of a connector for connecting sections of waveguide including a multiple-tube configuration adapted for adding particles to a bore-hole wall.

Figure 5:
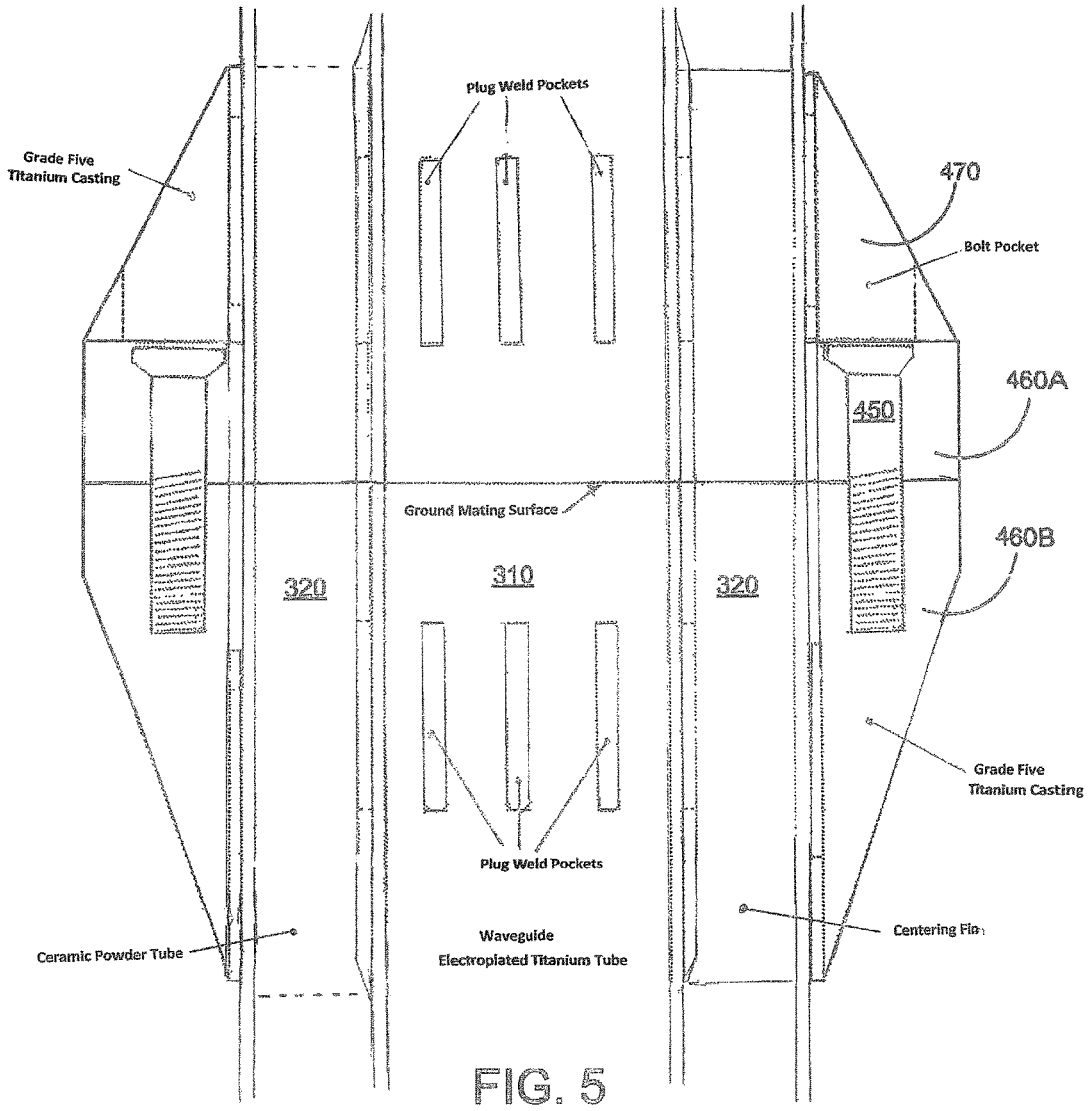

FIG. 5 is a elevation view of a connector for connecting sections of waveguide.

Figure 6A:
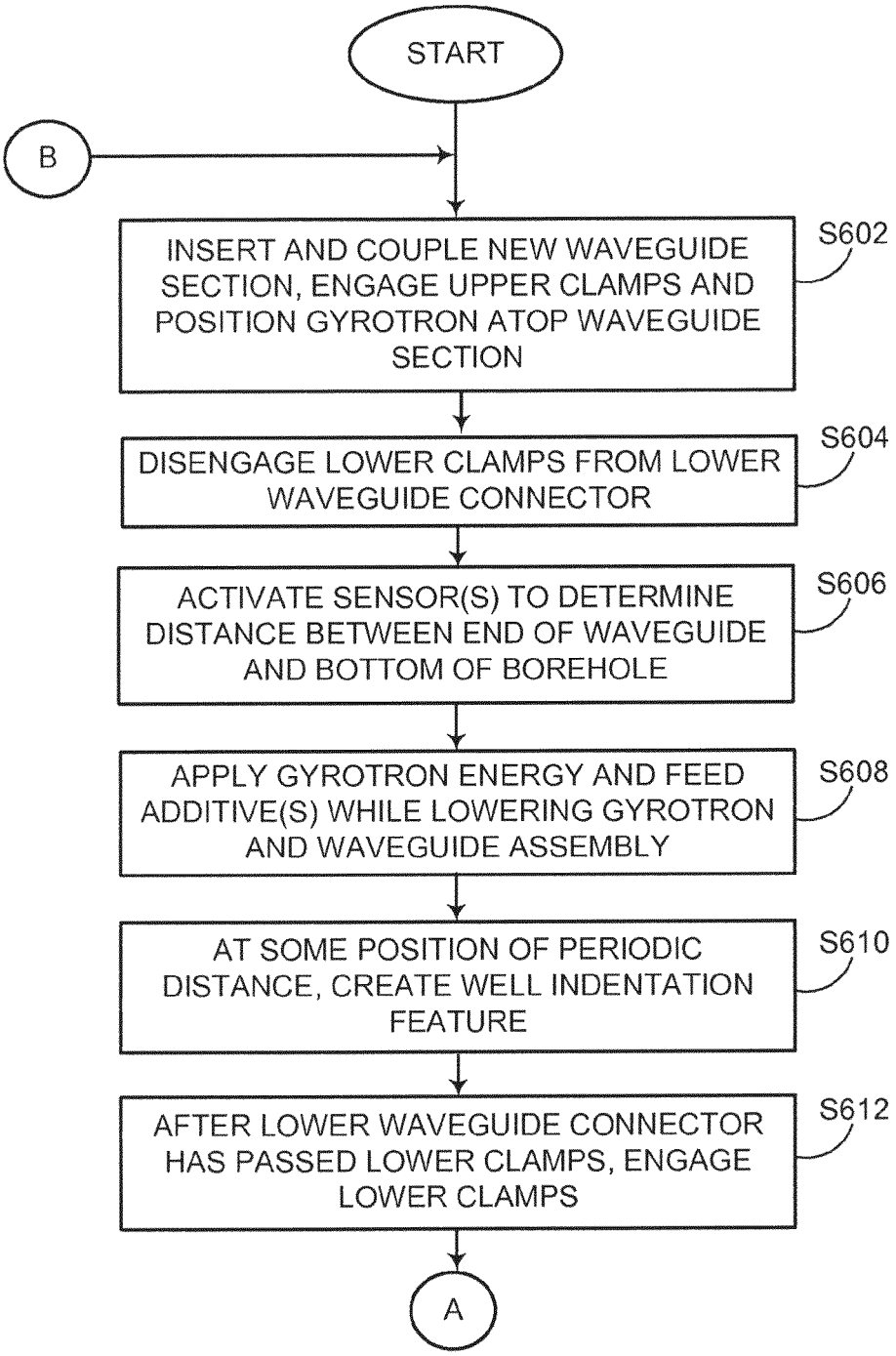
Figure 6B:
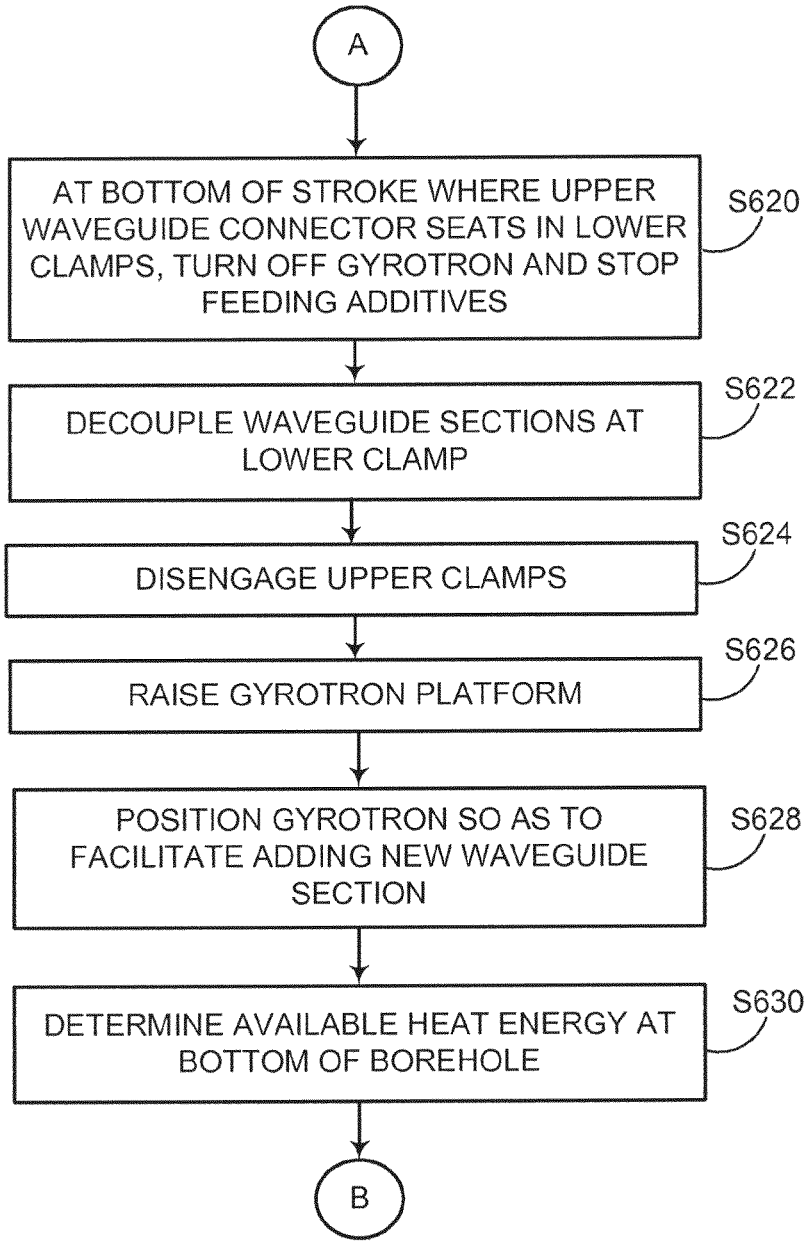

FIGS. 6A-6B depict a flowchart outlining a set of example operations useful for drilling.

Figure 7:
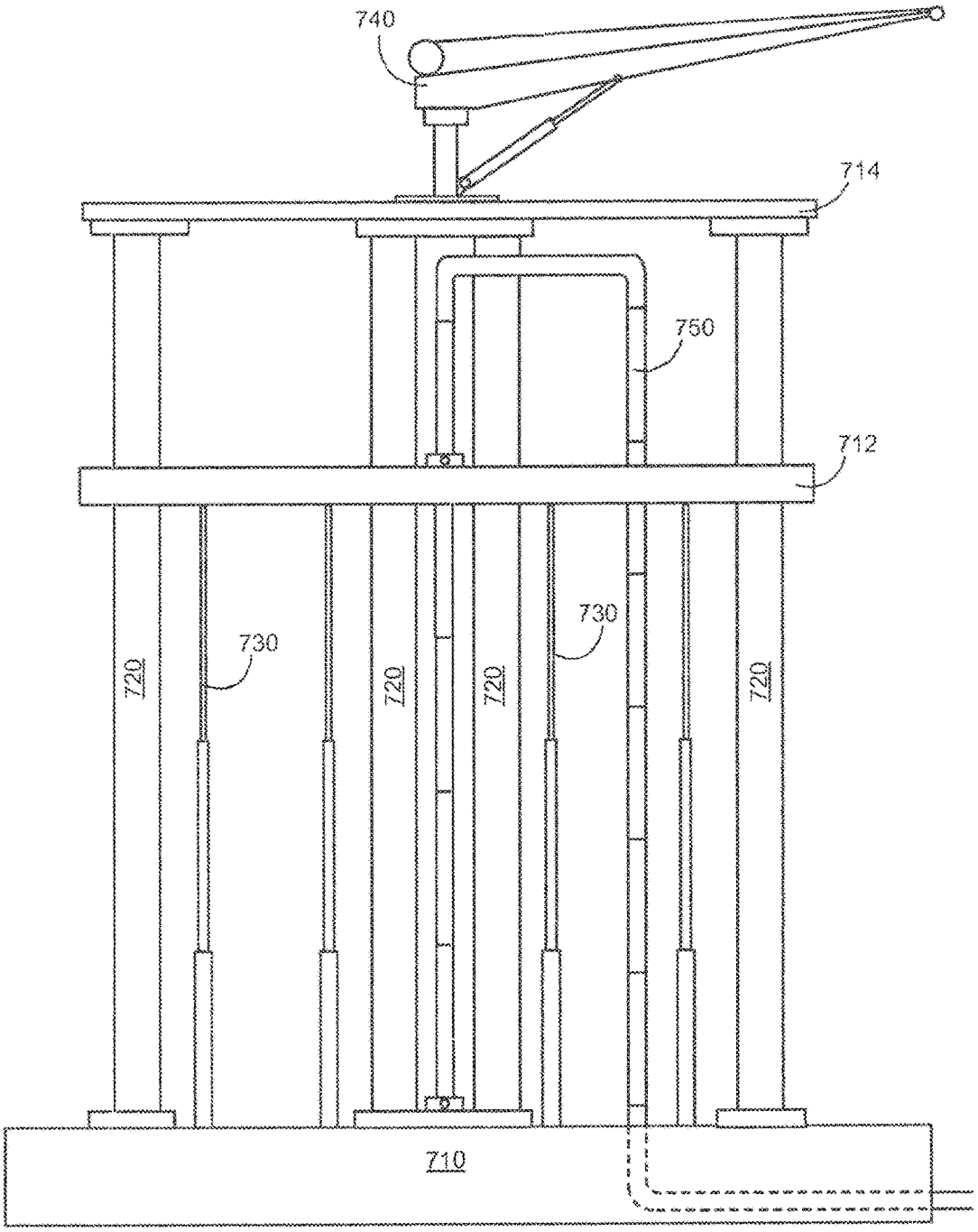
Figure 8:
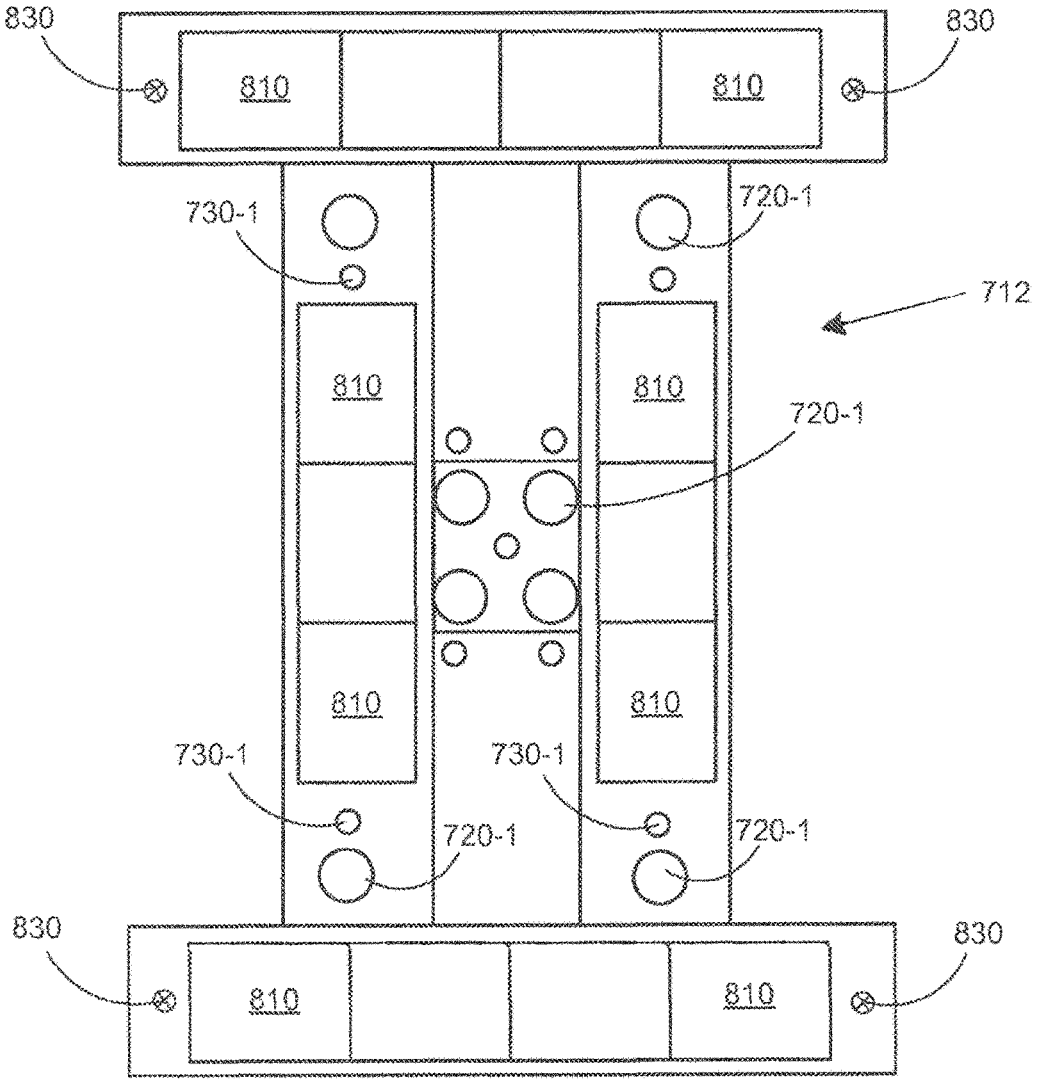
Figure 9:
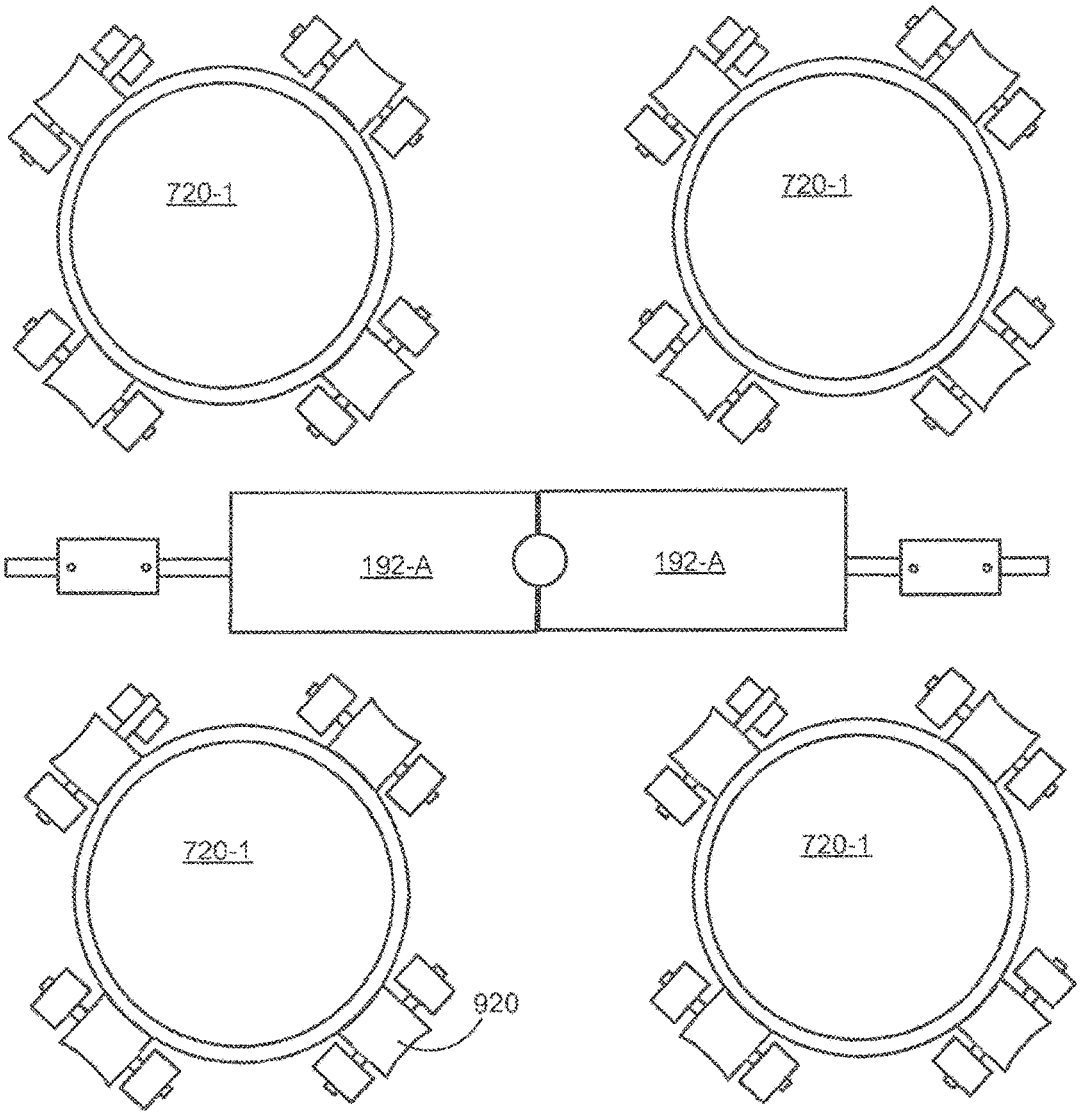

FIG. 7-9 depict mechanical details of an exemplary platform system useful for drilling boreholes.

Figure 10:
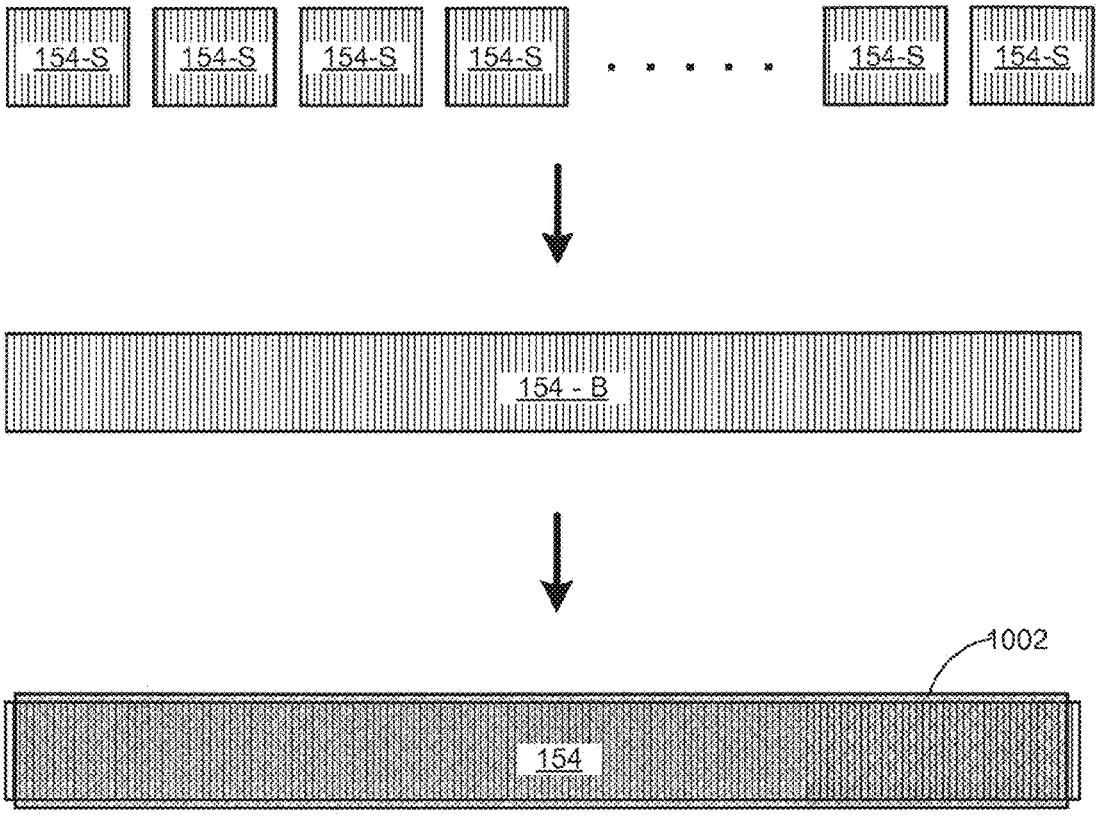

FIG. 10 depicts details of manufacturing a waveguide section.

Figure 11:
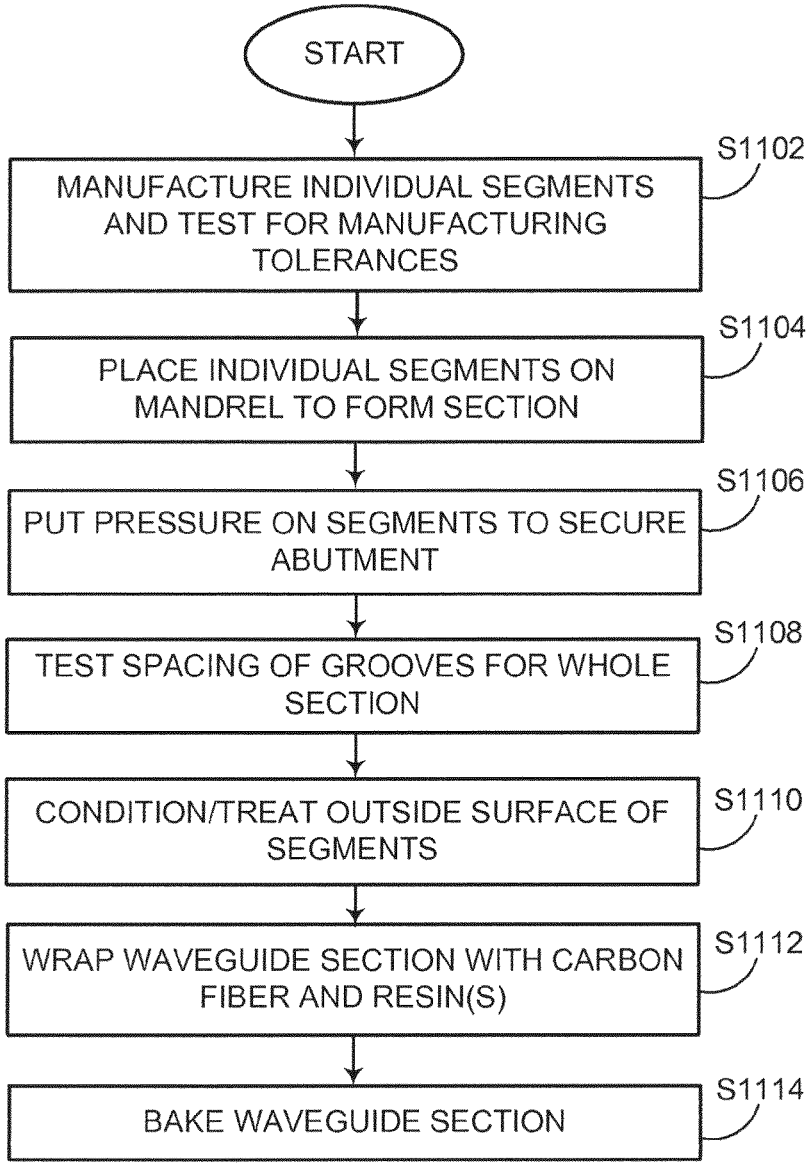

FIG. 11 is a flowchart outlining manufacturing steps for a waveguide section.

DETAILED DESCRIPTION OF EMBODIMENTS

The disclosed methods and systems below may be described generally, as well as in terms of specific examples and/or specific embodiments. For instances where references are made to detailed examples and/or embodiments, it is noted that any of the underlying principles described are not to be limited to a single embodiment, but may be expanded for use with any of the other methods and systems described herein as will be understood by one of ordinary skill in the art unless otherwise stated specifically.

FIG. IA is a generalized diagram of a system for drilling a borehole deep enough to economically extract geothermal energy. As shown in FIG. IA, a borehole 110 is drilled into ground 102 using millimeter-wave radiation energy from a gyrotron 150. For purposes of this disclosure, the term "gyrotron" may refer to a single device, or may refer to multiple independent gyrotrons used in a coordinated fashion to produce a single millimeter-wave beam.

A pressure device 170, e.g., a gas compressor, and a plug 130 serve to keep the waveguide and interstitial spaces pressurized, which will have a benefit of helping to remove vaporized rock and melt gasses. A nitrogen generator 172 incorporated with the pressure device 170 enables the pressure device 170 to provide substantially-pure nitrogen into the borehole with the term "substantially" in this context meaning sufficiently concentrated and/or devoid of other gases, such as oxygen and water vapor, so as to prevent any dangerous levels of combustion within the borehole 120 and/or to facilitate transmission of millimeter wave energy given the absorption characteristics of oxygen and water vapor. In operation, the pressure device 170 will provide nitrogen under pressure down the center of the waveguide (to keep the waveguide clear of particulate matter), and provide pressure to supply additives (as will be discussed below). During various operational embodiments, nitrogen purge gas pressure will be increased linearly to balance litho-static pressure exerted on the borehole by the surrounding rock, and will increase as the well bore descends, controlled by a pressure and flow valve (not shown) located after the wellhead and before a particle filter, which may be used to remove fine particles from gases flowing out of the borehole. Gas pressure can be at least sufficient to balance litho-static pressure starting at 15,000 feet with a maximum pressure to balance litho-static pressure preferably up to at least ten miles deep. In other embodiments, however, it is not necessary to perfectly balance litho-static pressures, but to merely provide pressure so as to prevent the borehole wall from succumbing to litho-static pressure. For example, in an area where rock strata can withstand 40,000 psi, but litho-static pressure is 60,000 psi, a mere 20,000 psi of pressure (plus optional margin) may be sufficient.

It is to be appreciated that, in addition to, or in place of, nitrogen, other gases may be used so long as such gases can inhibit combustion and adequately transmit gyrotron energy. For example, argon or another noble gas may be used, although at a possible greater expense.

A sensor array S incorporated as part of the gyrotron 150 enables the gyrotron 150 to dynamically or statically measure the distance between the bottom of waveguide section 156 and the bottom of the borehole 110. This sensed distance can enable the gyrotron 150 and waveguide sections {154, 156} to be lowered such that the lowermost portion of waveguide section 156 is a constant or otherwise controllable distance to the bottom of the borehole as the borehole deepens. The sensor array S can also measure borehole temperatures. In a variety of embodiments, the sensor array S can contain any number of laser or other electromagnetic distance measuring devices as is well-known in the relevant arts, including time-domain reflectometry equipment. The sensor array S can also contain infrared/heat sensors.

As rock and other strata are melted, the melted matter propagates into subsurface form and forms as the borehole's walls 120 while vaporized rock can make its way up the borehole 110. Details of a gyrotron drilling system can be found in U.S. Pat. No. 8,393,410 entitled "Millimeter-wave Drillling System" to Paul Woskov et al., the content of which is incorporated in its entirety. Energy is delivered from the gyrotron 150 into the borehole 110 by a number of waveguide sections including intermediate waveguide sections 154 and a lower waveguide section 156. Unlike any prior art of record, however, the present drilling system uses a series of hydraulic pistons 190 to control the rate of descent. When used in conjunction with the sensor array S, the hydraulic pistons 190 can be controlled in such a manner so as to controllably keep the diameter of the borehole 110 relatively constant, and the bottom of waveguide section 156 at a constant distance (or at least within a narrow range of distances) to the bottom of the borehole 110. Keeping such a constant distance can greatly improve on energy usage, preserve uniformity of the borehole 110 and borehole walls 120, and increase speed of energy penetration.

The gyrotron drilling system of FIG. IA can be optionally enhanced using an additive device 160 configured to add any number of substances, e.g., glass-forming materials, to the melted matter such that the walls 120 of the borehole 110 can be enhanced in a number of ways. For example, the walls 120 can be hardened, become more crack resistant, become more heat insulative or more heat conductive, or become more plastic in nature. The additive device 160 can be made adaptive according to the makeup of a particular strata of rock and a particular depth. That is, the types of additives provided by the additive device 160 can vary according to the type of rock that the gyrotron 150 is currently melting. Knowledge of the type and makeup of rock can be determined using the detector 180, which can perform a number of tests, e.g., chemical reaction tests, gas chromatography, mass spectrometry, and so on.

The gyrotron 150, additive device 160 and pressure device 170 are mounted on a vertically-mobile platform 191 capable of being raised and lowered by the hydraulic pistons 190. A set of upper clamps 192A incorporated into the platform 191 is used to engage and hold the waveguide sections 154 at connectors between the waveguide sections {154, 156}. A set of lower clamps 192B incorporated into the base of the drilling system is similarly used to engage and hold the waveguide sections 154 at their connectors as will be discussed below. Each intermediate waveguide section 154 has a common length L.

Figure 1A:
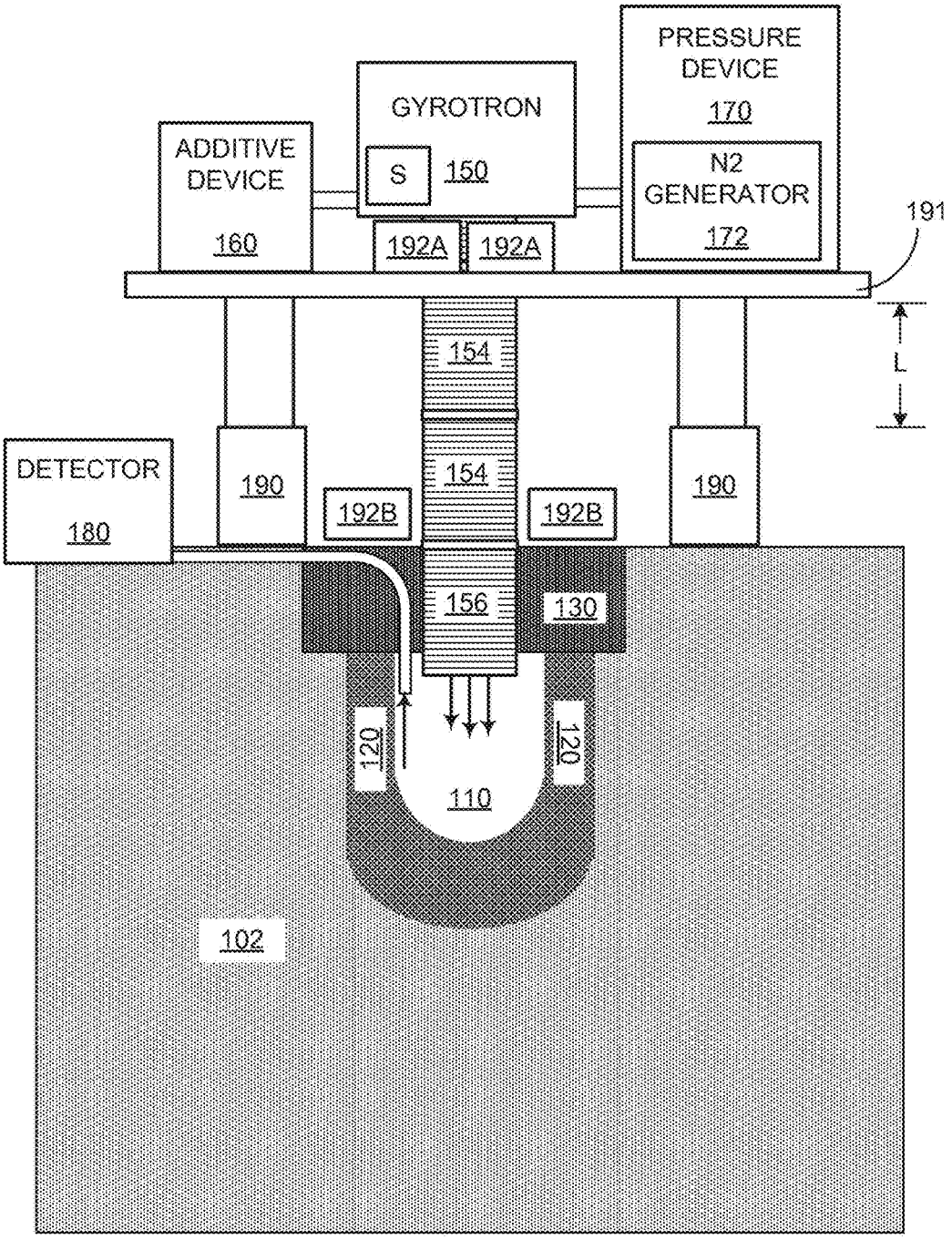
Figure 1B:
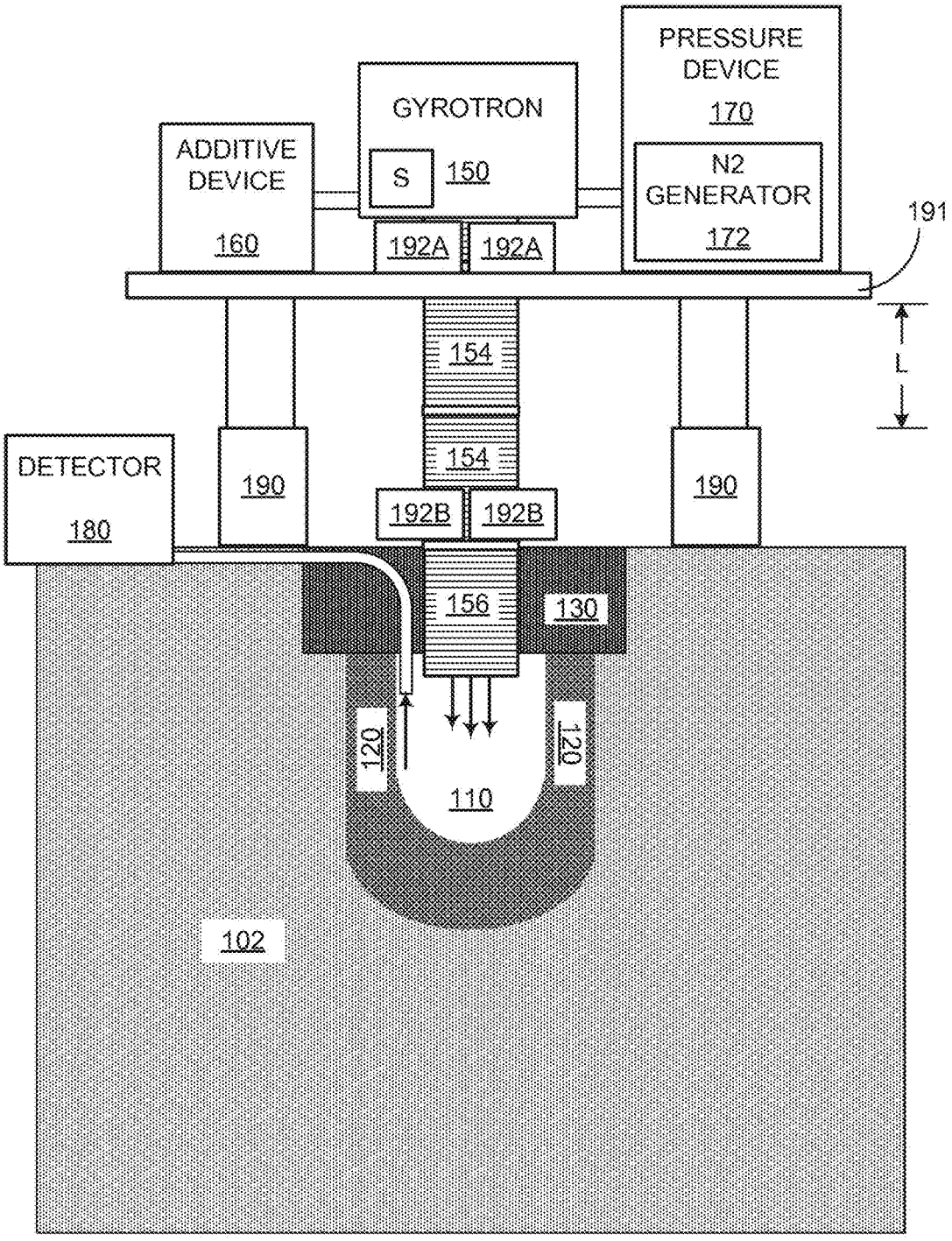
Figure 1C:
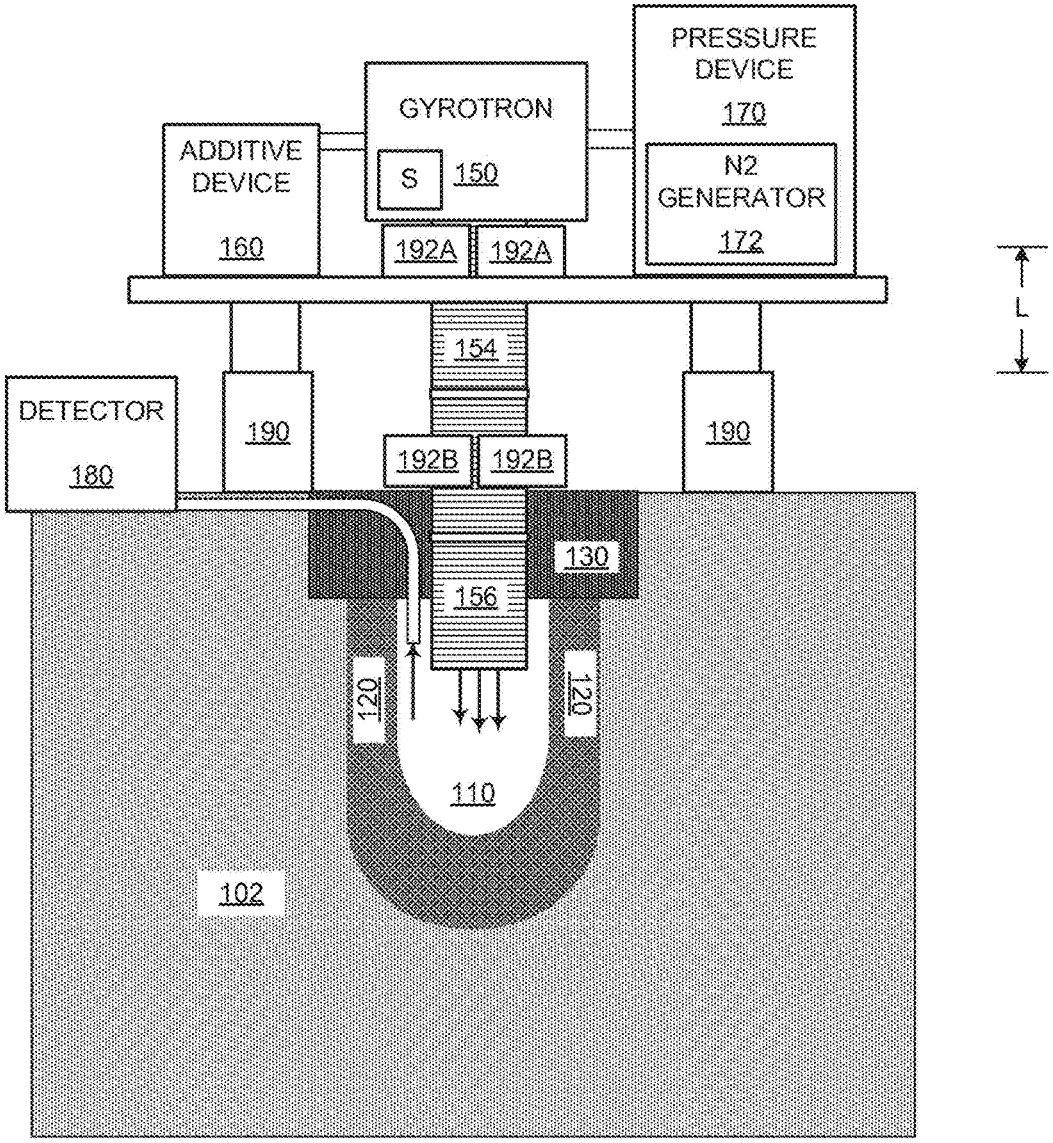
Figure 1D:
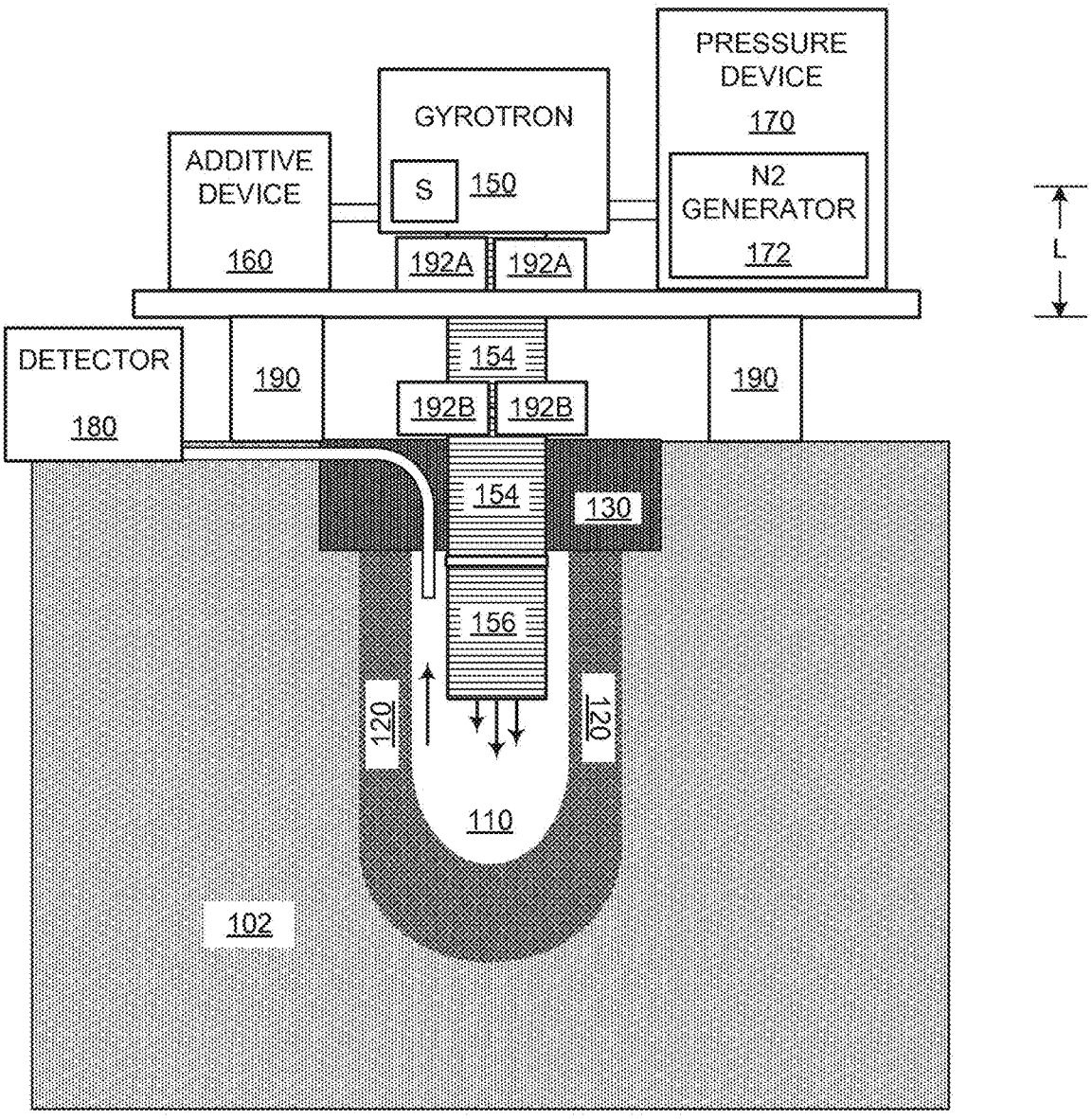
Figure 1E:
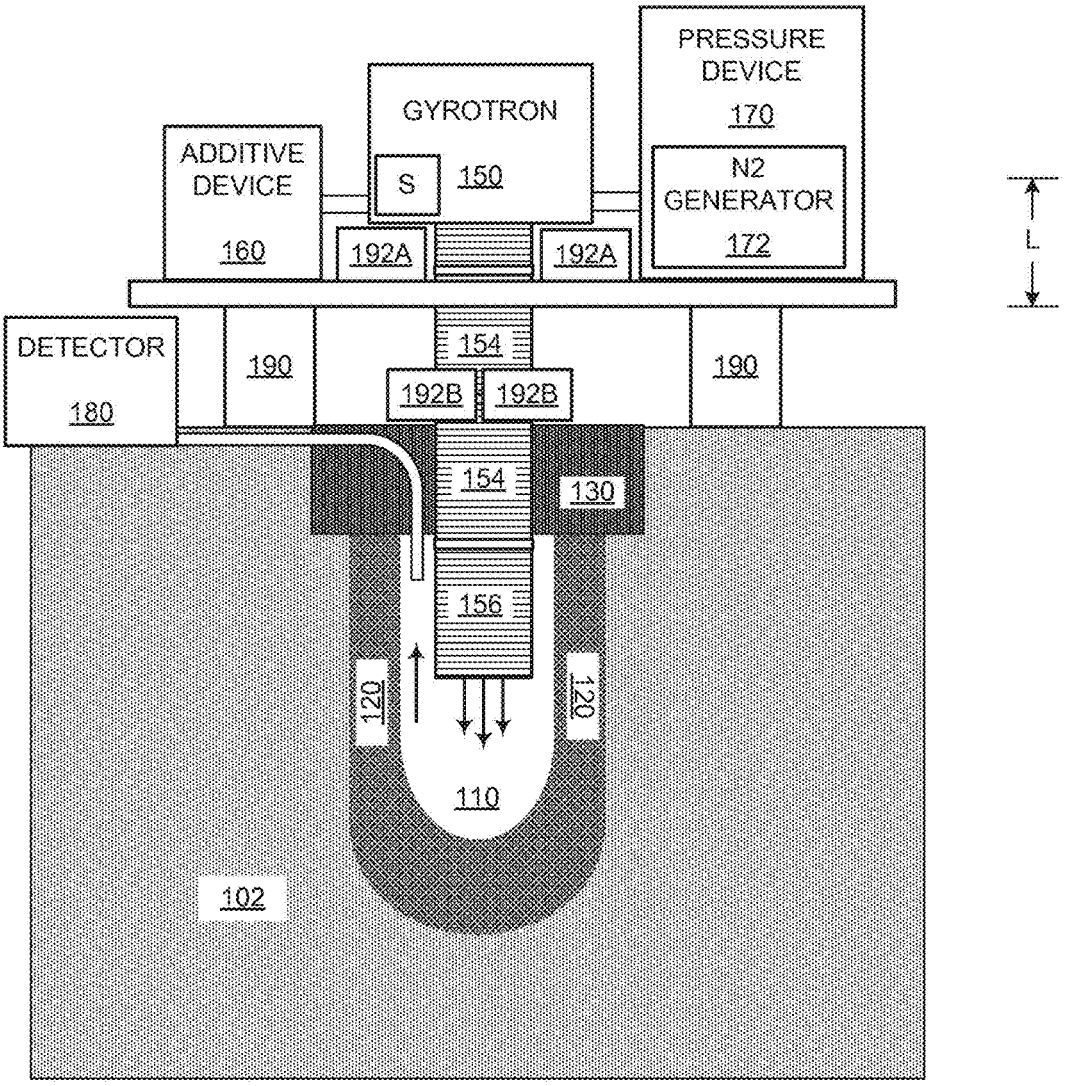

FIG. 1B is a first depiction of the drilling system of FIG. IA as the vertically-mobile platform 191 is slowly lowered by the pistons 190 and with both the upper clamps 192A and the lower clamps 192B engaged. As shown in FIG. 1B, as the vertically-mobile platform 191 is lowered, the borehole 110 deepens in response to gyrotron energy while additives from the additive device 160 are deposited into the borehole walls (at the sides) optionally using the detector 160 for feedback to adjust the amount and type of additives. That is, as the gyrotron 150 (or other device capable of providing directed energy), is activated, rock directly below the waveguide and in front of the directed energy will vaporize while rock at the periphery of the directed energy will liquefy. It is the vaporized rock that can be sampled and analyzed by the detector 180 to determine its chemical composition using any number of well-known or later-developed instrumentation. Using this information, it can be determined which additives are appropriate to add such that, when mixed with the liquefied rock, will cause the resultant re-solidified rock to take on desirable properties, e.g., harder, more crack resistant, more insulative, more plastic, and so on. Accordingly, the walls 120 will be formed according to an improved chemical and mechanical makeup as compared to walls without additives.

FIG. IC is a depiction of the drilling system of FIG. IA as the vertically-mobile platform 191 is further lowered, and FIG. ID depicts the drilling system of FIG. IA as the lower clamps 192B (engaged) come into contact with a connector between waveguide sections 154. At this point, the entire weight of the various waveguide sections 154 and 156 can be supported by the lower clamps 192B, and section 153 is disconnected from intermediate waveguide section 154. It is to be appreciated that, as will be shown below, the lower clamps 192 are configured to allow clearance to the walls of the waveguide sections 154 such that they may freely pass through until a waveguide connector makes contact.

Figure 1F:
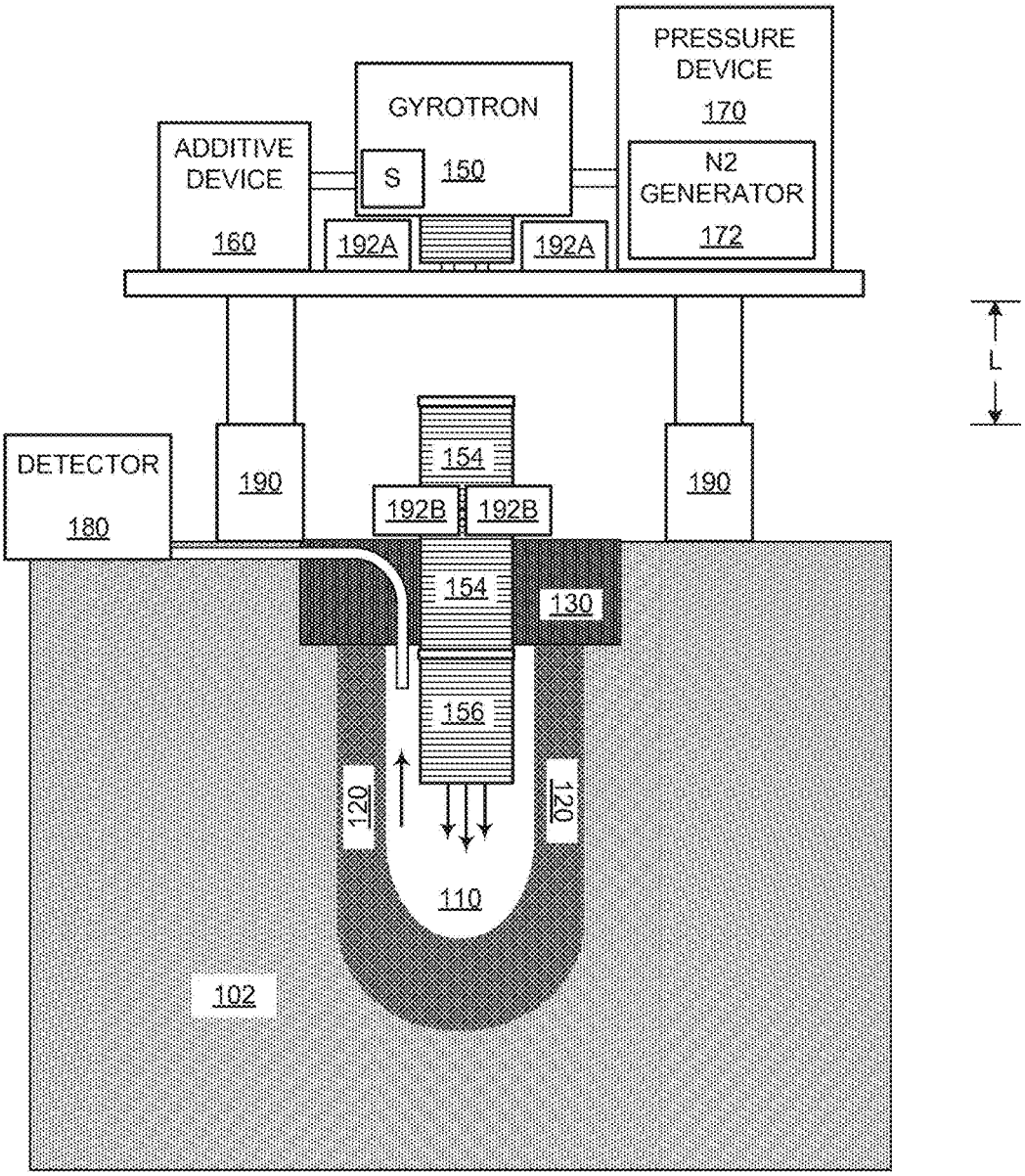
Figure 1G:
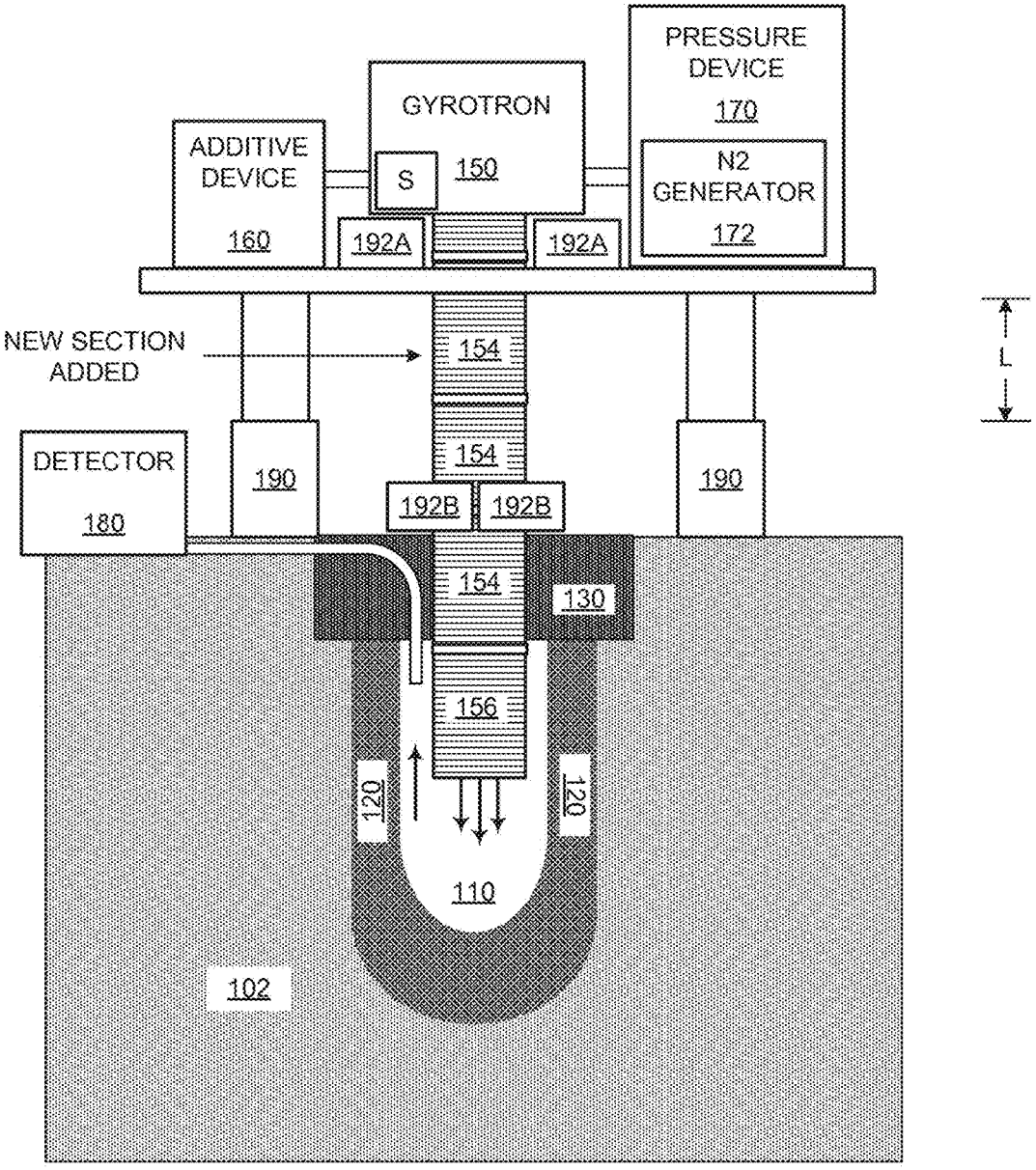
Figure 1H:
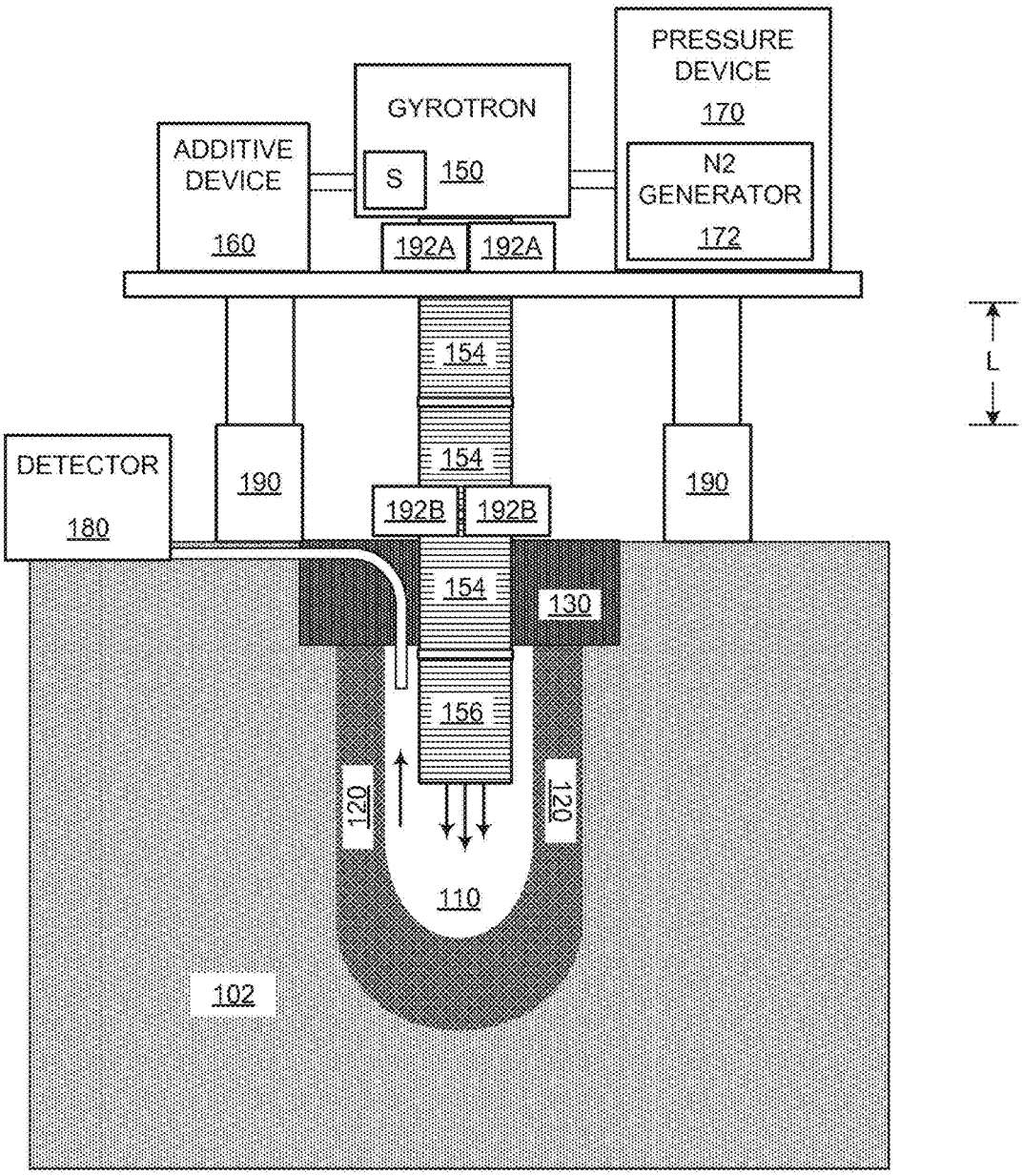
Figure 1I:
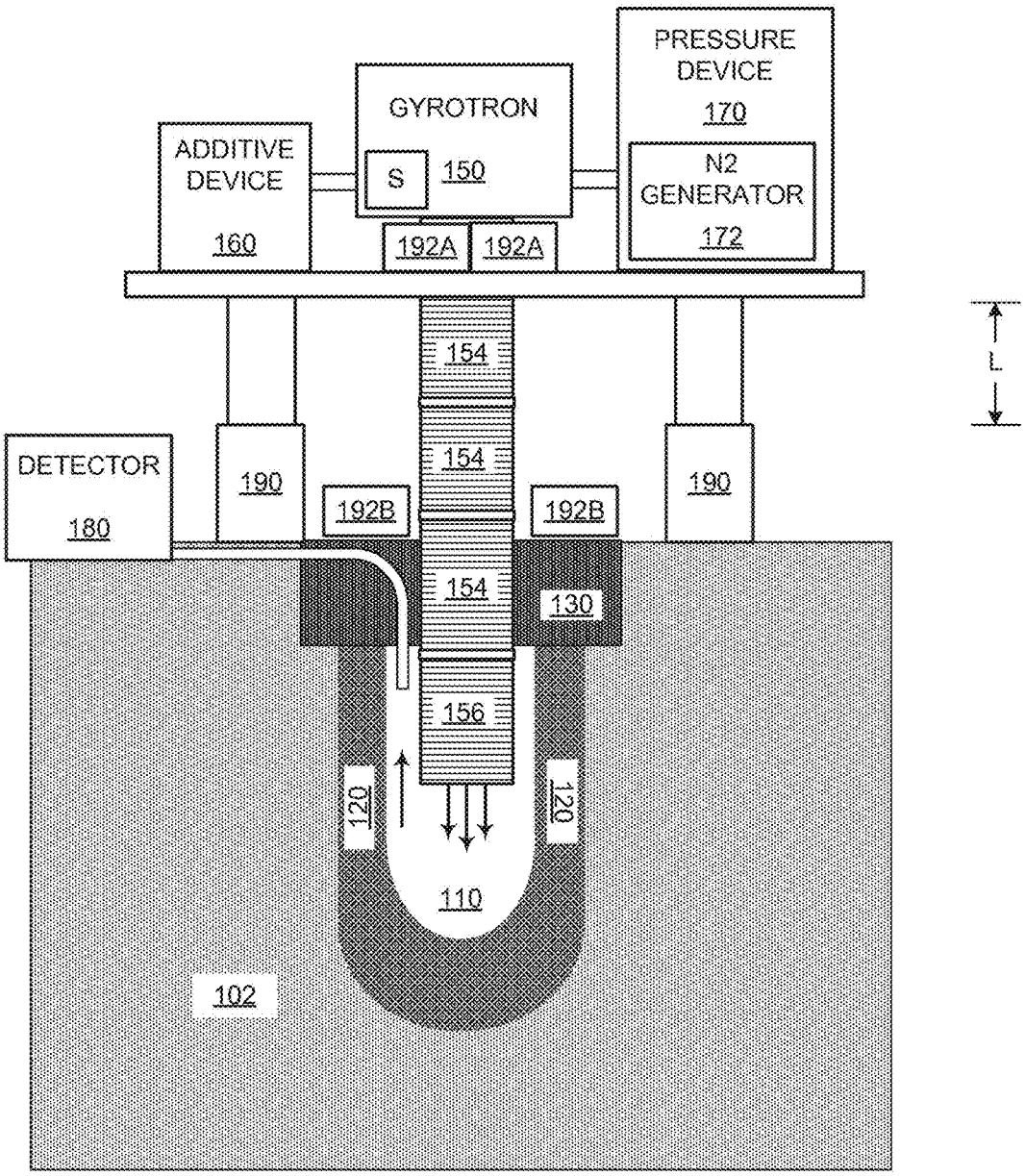

FIG. IE depicts the drilling system of FIG. IA as the upper clamps 192A are disengaged, and FIG. 1F depicts the drilling system after the upper waveguide sections are de-coupled and the vertically-mobile platform 191 is raised.

Figure 1J:
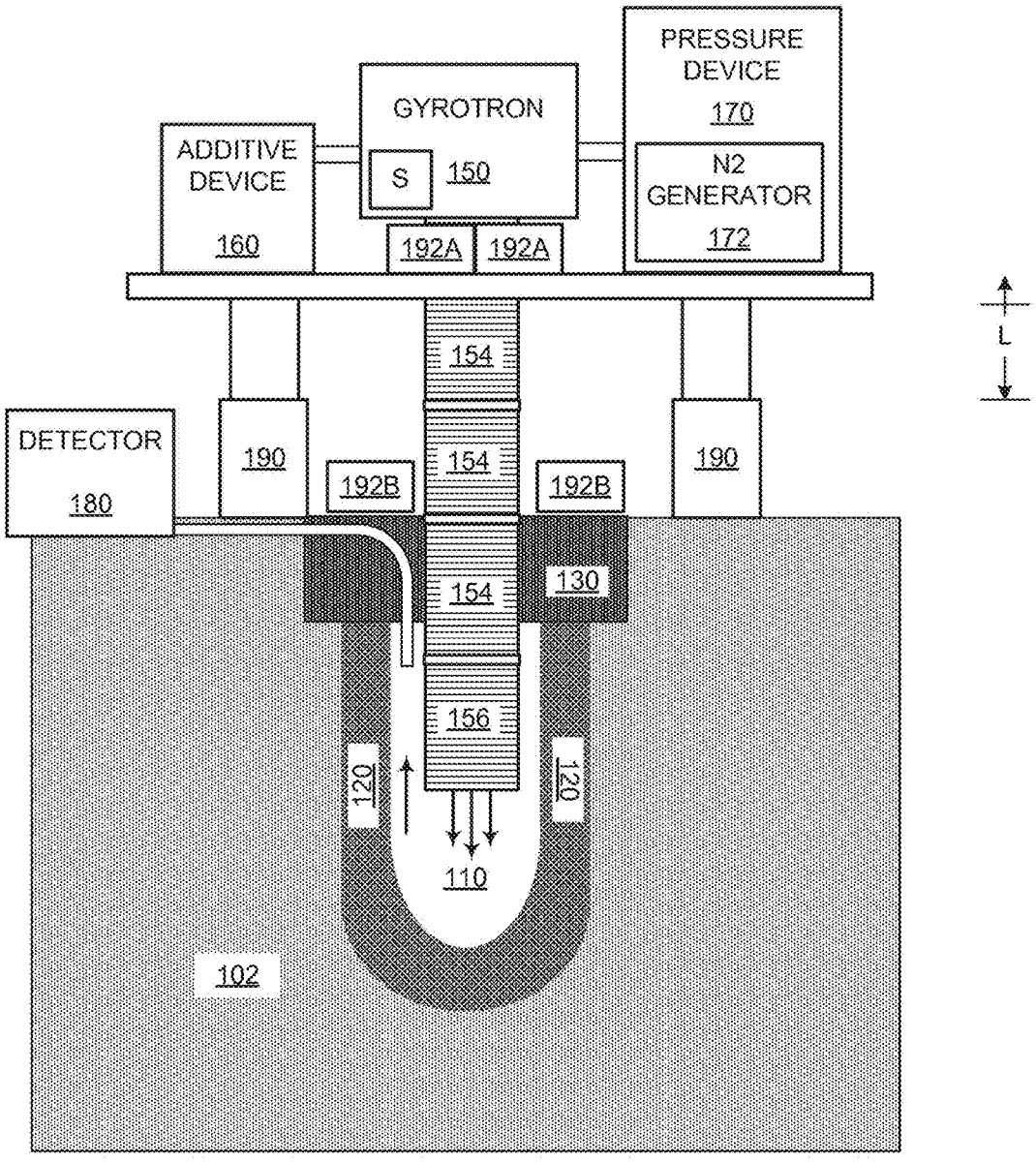
Figure 1K:
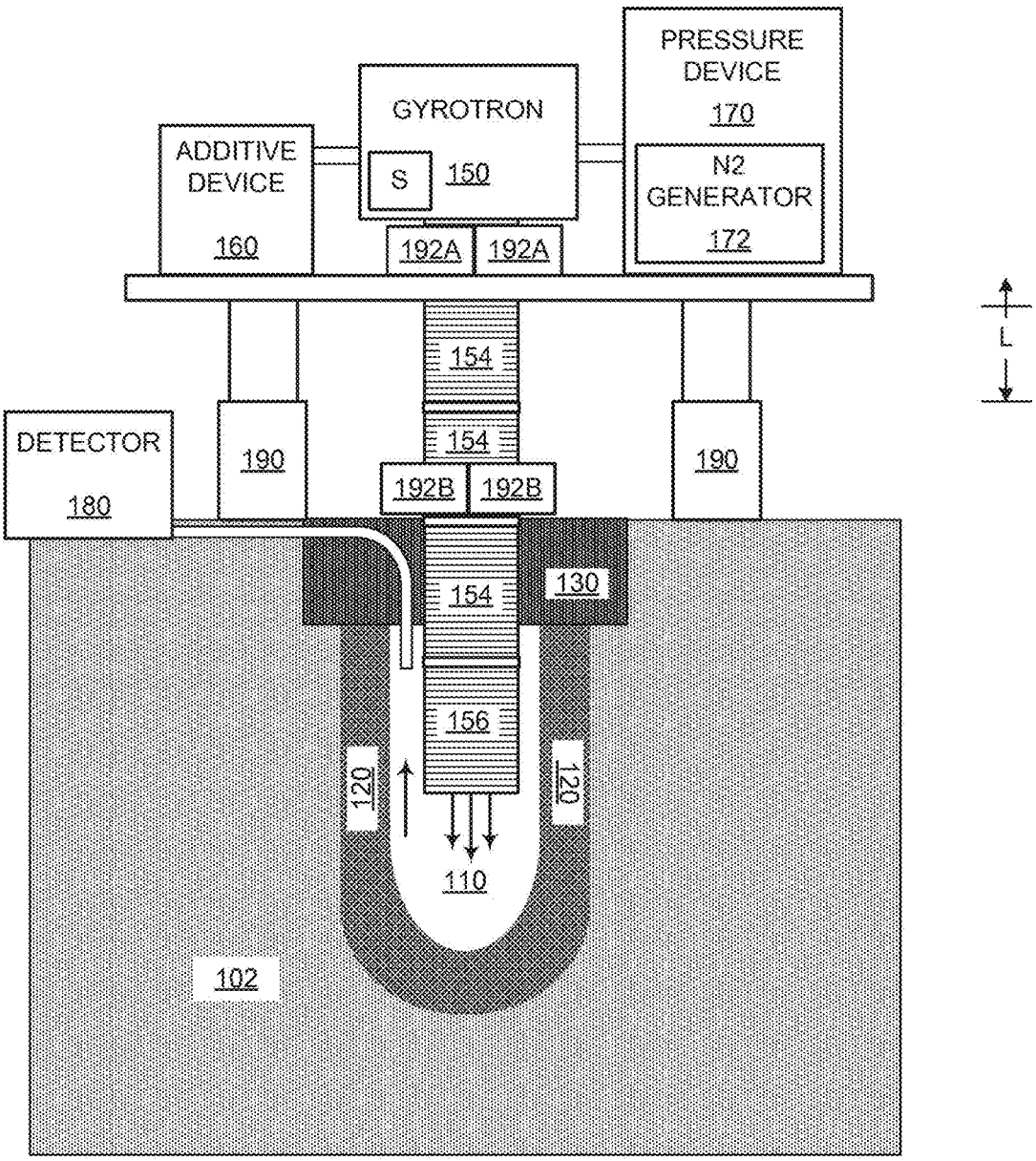
Figure 1L:
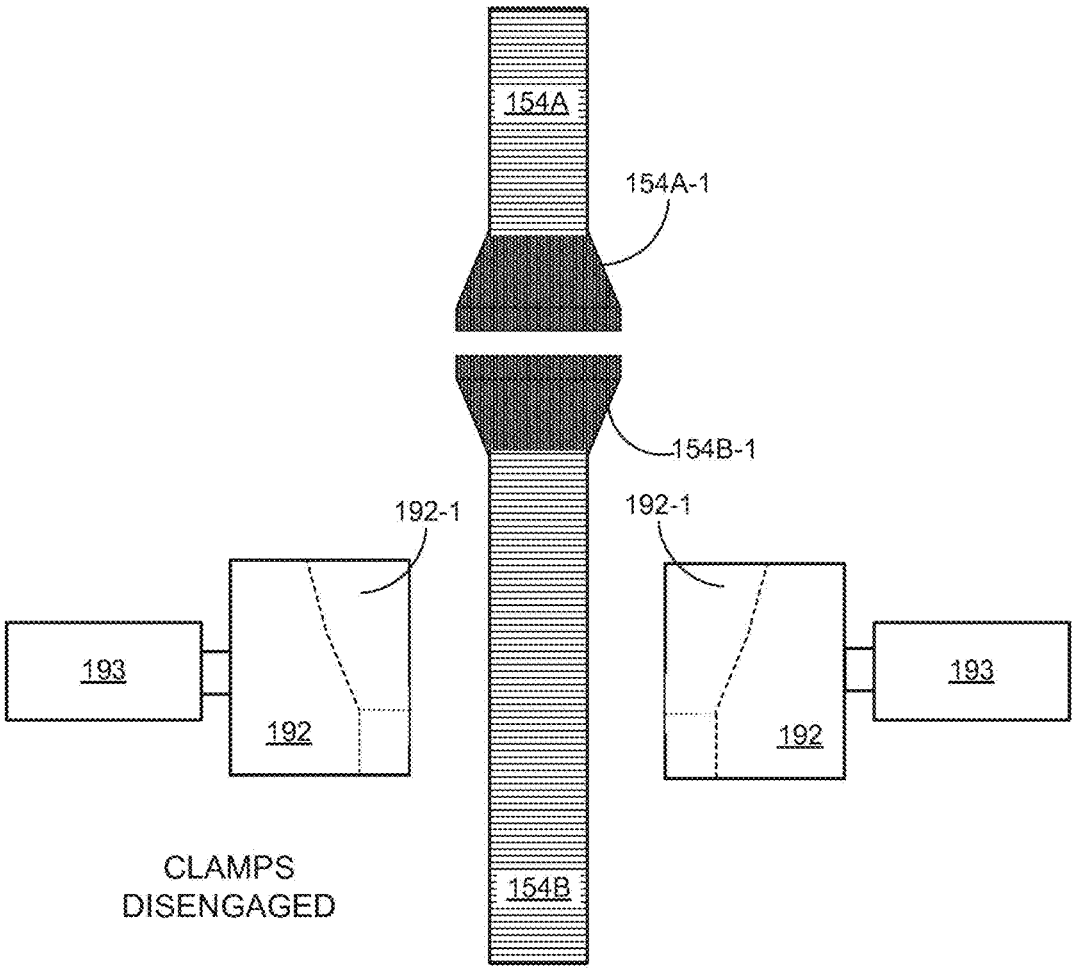
Figure 1M:
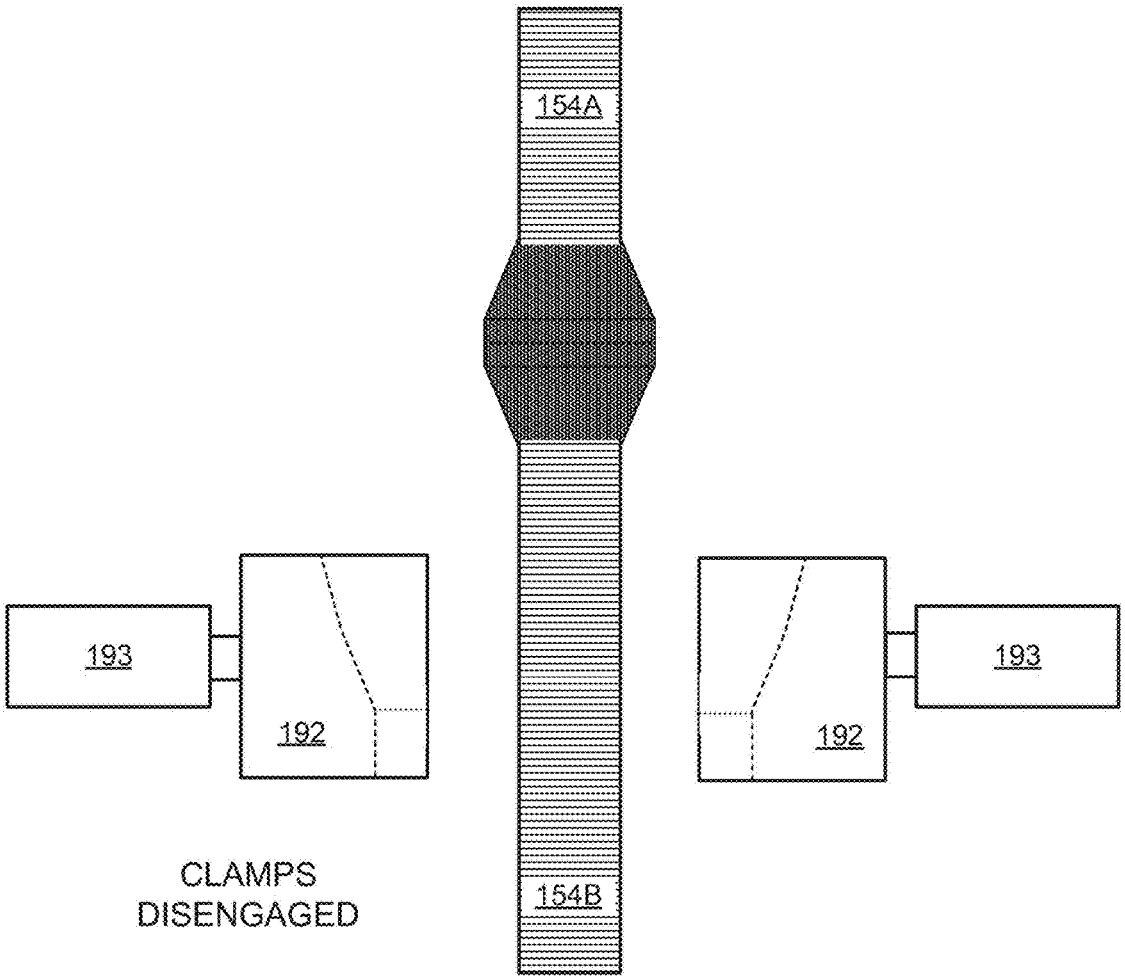
Figure 1N:
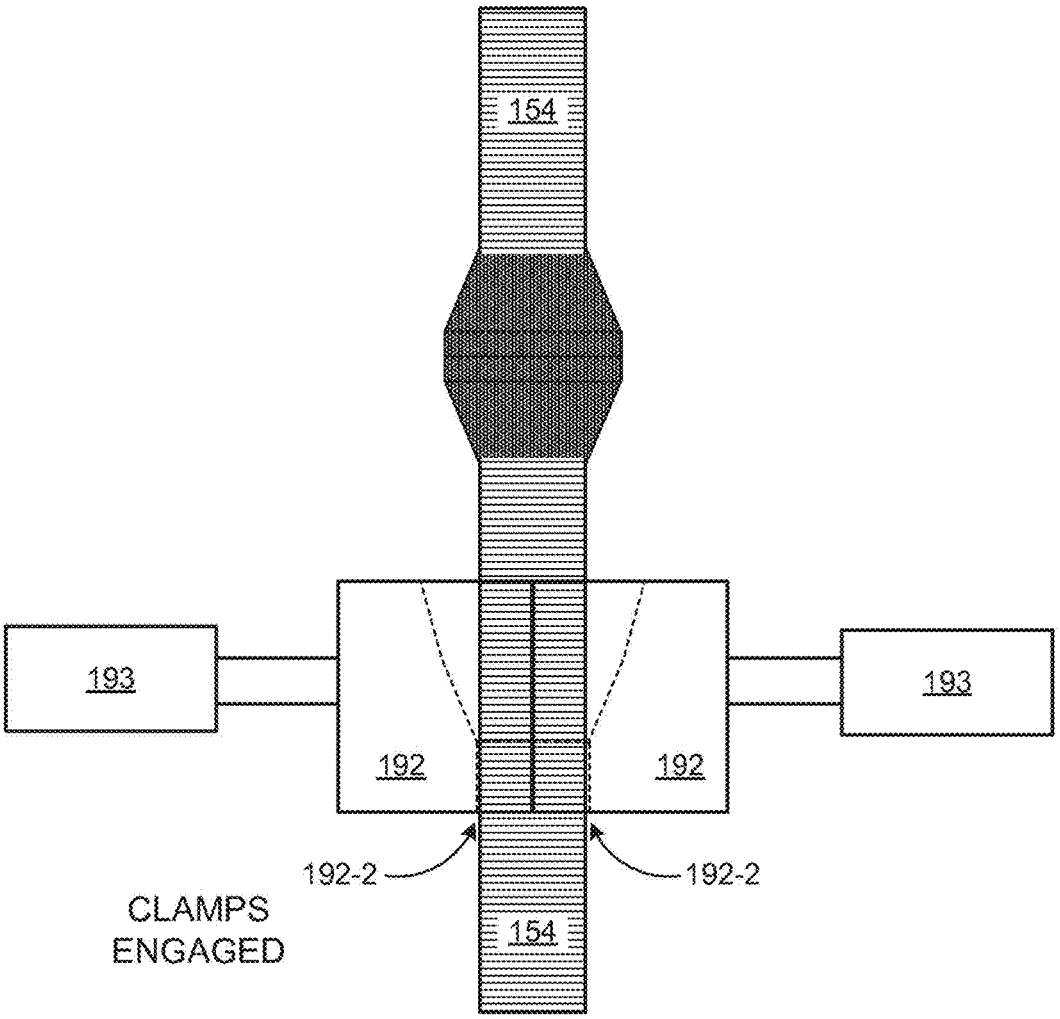
Figure 1P:
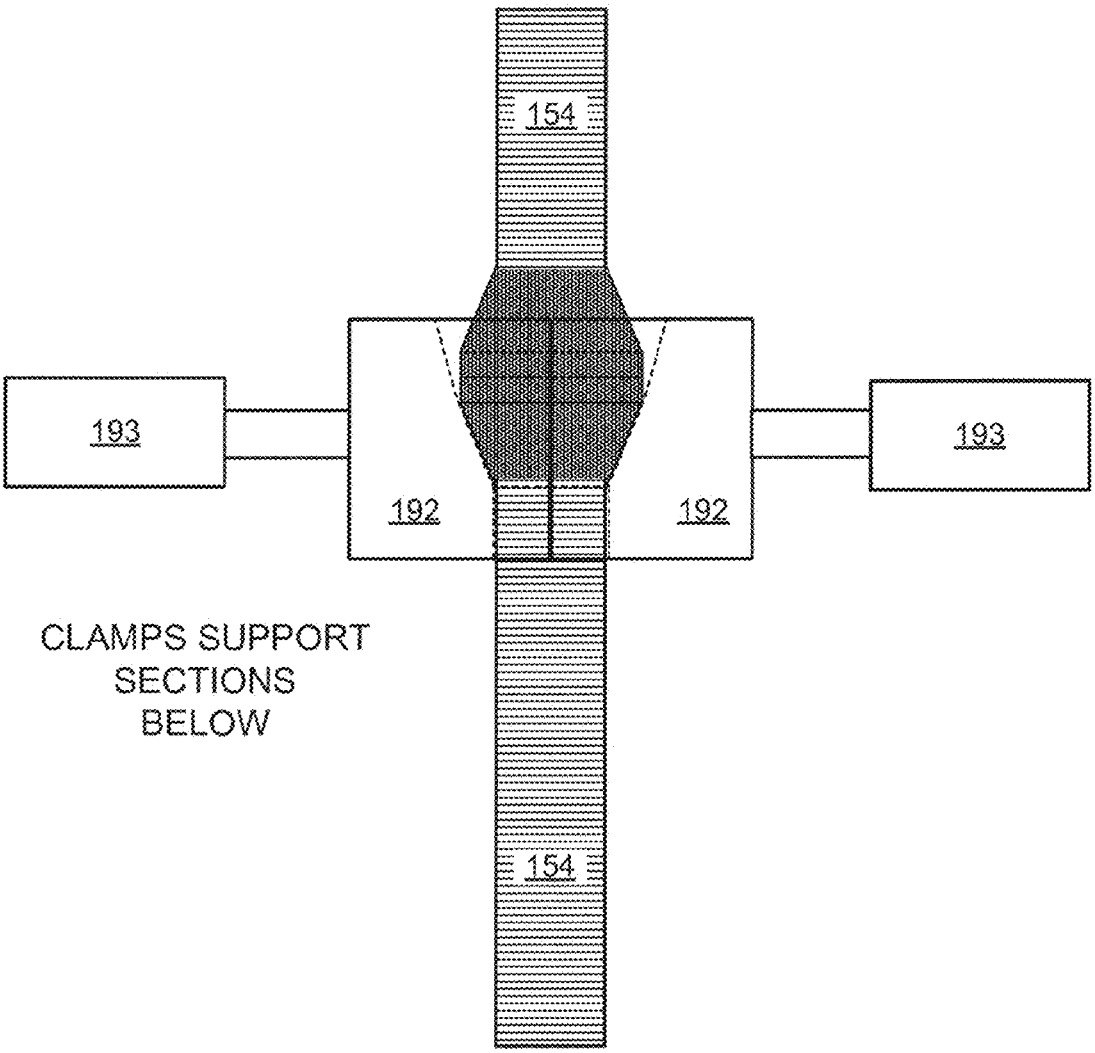

FIG. IG is a depiction of the drilling system of FIG. IA with a new intermediate waveguide section 154 added and coupled to its neighboring (lower) waveguide section 154. FIG. IH depicts the upper clamps 192A being engaged and, as with the lower clamps 192B, the upper clamps 192A are capable of supporting the waveguide sections 154 and 156. FIG. II then depicts the lower clamps 192B being disengaged, and FIG. 1J depicts the drilling system being lowered again. After the drilling system is lowered such that the waveguide connector previously engaged by the lower clamps 192B has descended to a point below the lower clamps 192B, the lower clamps are again engaged as is shown in FIG. IK.

FIGS. IL, IM, IN and IP depict details of the interaction between the lower clamps 192B of FIGS. IA-IG and various waveguide sections 154. As shown in FIG. IL, there is an upper waveguide section 154A with upper connector 154A-1, a lower waveguide section 154B with lower connector 154B-1, and two clamp portions 192 having positions controlled by hydraulic pistons 193. The two clamp portions 192 have internal contours 192-1 that allow waveguide sections to pass through but not connectors. While the internal contour 192-1 and connectors 154A-1 and 154B-1 are conical, in other embodiments such contours 192-1 can vary so long as the stops 192 are capable of using connector 154B-1 to bear the weight of all connector sections below it.

FIG. IM depicts the two waveguide sections 154A and 154B joined, and FIG. IN depicts the clamps engaged about waveguide section 154B as the waveguide sections 154A and 154B descend. As is indicated, a small clearance 192-2 of contour 191-1 is provided between the clamps 192 and waveguide section 154B. FIG. IP depicts the clamps 192 engaged and making contact with connector 154B-1.

At some portion of length L, the vertically-mobile platform 191 can be paused or slowed and/or the energy output of the gyrotron 150 and be adjusted such that, at regular intervals, indentations in the borehole wall can be made. A good candidate time may be when the clamps 192 have come into contact with a waveguide connector 154B-1.

FIG. 2 depicts an exemplary geometry of a borehole from a side/elevation view. As shown in FIG. 2, concave indentations (not drawn to scale) are provided at intervals L (e.g., every 50 feet) whereby portions of a pressure vessel (or other pipe-shaped device) later fitted into the borehole 110 can be extended so as to make contact with the indentations so as to provide mechanical support to the pressure vessel. FIG. 2B depicts the borehole 110 of FIG. 2 with pressure vessel. As shown in FIG. 2B, pipe-shaped lengths 210 are connected at connectors 220. Extendable stabilizers 222 (or some other mechanical device) extend from the connectors 220 and into the concave portions of borehole wall 120. However, stabilizers (e.g., stabilizers 222A) may be deployed so as to keep the pipe segments 154 centered in the borehole and help distribute the weight of the pressure vessel.

FIG. 3 depicts general structural details of waveguide portions 154 and 156. As shown in FIG. 3, the waveguide portions 154 and 156 are connected at connecting portions 300, and have an inner waveguide portion 310 and an interstitial waveguide portion 320. It is the inner waveguide portion 310 that allows gyrotron energy to propagate downward in an efficient fashion while the interstitial waveguide portion 320 is used to deliver additive particles. Optional directional flair structures 322 can be used to direct additive particles at an appropriate angle into borehole walls, i.e., to portions of the borehole 110 where rock strata is liquefied but not vaporized. Additive particles, e.g., glass-forming materials, can aid in forming a borehole wall with improved mechanical and chemical properties.

As mentioned above, the directional flair structures 322 (with mixer spray nozzles added) can also be used to direct a coating material, e.g., a sealant, on the borehole walls as the waveguide is being withdrawn. Such a coating material may, for example, consist of a high-temperature flexible material that would bend, rather than break, and perhaps provide a filler and stabilizing material for cracks in the borehole wall.

FIG. 3B is an alternative embodiment of the portion of waveguide section 156 of FIG. 3 in context to a portion of borehole wall 240. In this embodiment, the lowermost waveguide section 156 includes a plurality of radial-extending, curved and flexible spars 380. Each spar 380 includes a sensor 382, e.g., a pressure or contact sensor. Accordingly, when a particular spar 360 one comes into contact with a portion of the borehole wall 240, such as spur 390, the respective sensor 382 will register contact. Assuming that the sensor 382 is a simple contact sensor causing a current loop to make or break circuit, the current loop can be easily monitored from the surface. Accordingly, when a spar makes contact with the borehole wall 240, the waveguide can be raised and re-lowered to widen the borehole and/or remove any spurs or other undesirable borehole features.

FIG. 4 depicts example details of the connector portion 330 of FIG. 3 from a plan view. As shown in FIG. 4 the inner waveguide 310 is lined with a thin copper layer 410. The materials of the outer structures may be made from titanium or a titanium alloy, a specialty polymer and/or from carbon fibers, basalt fibers or other similar fibers. The interstitial portion 320 of FIG. 3 is shown as divided into portions 320A divided by radial members/flanges 420 and surrounded an outer shell 424. Unless otherwise stated, all portions of a waveguide section and connector portion can be made from titanium or a titanium allow, but again as stated above other materials can be used. Titanium bolts 450 threaded through an outer structure 460 are used to connect and disconnect waveguide sections. The number of titanium bolts 450 can vary depending on depth. That is, the lowermost waveguide sections within a borehole can be connected using fewer bolts, e.g., three bolts, because the amount of weight needed to be supported is less than for waveguide connections higher up. The number of connecting bolts will increase over time as a borehole is drilled deeper. This may be accomplished by populating only a portion of bolt holes, or by using differently constructed waveguide sections having connector portions with different numbers of bolt holes. By strategically limiting the number of bolts, weight and costs can be reduced. An alternative would be a large threaded connection as is used in the oil drilling industry.

FIG. 5 depicts example details of the connector portion 330 of FIG. 3 from a side view. FIG. 5 shows the inner waveguide portion 310, the interstitial waveguide portion 320, bolts 450 and outer structure 460, which is divided into an upper connector structure 460A and a lower connector structure 460B. While the bolts 450 are threaded vertically relative to the length of the waveguide portions (via holes 470 in structure 460A), in other embodiments the bolts 450 may be threaded at an angle.

FIGS. 6A-6B depict a flowchart outlining a set of example operations useful for drilling. While the various operations are depicted as a sequence, it is to be appreciated that some of the operations may occur in a simultaneous or in an overlapping fashion. Similarly, the order of various operations may be varied. Such variances from the flowchart structure of FIGS. 6A-6B will be apparent to those skilled in the various arts.

The operation starts with step S602, where a new waveguide section is inserted and coupled (e.g., bolted to) to a waveguide consisting of a plurality of waveguide sections positioned beneath the new waveguide section. A set of upper clamps is engaged to couple the upper end of the new waveguide section to a moveable platform, and a gyrotron is then position atop of the new waveguide section. Next, in step S604, a set of lower clamps is disengaged such that the weight of the waveguide is supported by the upper clamps. As discussed above, such clamps can have an internal profile matching (or otherwise capable of accommodating) the profile of waveguide connectors. Then in step S606 a set of sensors is used to determine a distance between the bottom end of the waveguide and the bottom of the borehole. Control continues to S608.

In step S608, millimeter-wave (e.g., from 25 GHz to 300 Ghz, and in some embodiments strategically 95±5 GHz) energy is supplied from a suitably-powered gyrotron (for example, one or more gyrotrons coupled together to form a 3.2 to 6.4 megawatt beam), and additives are fed into the borehole in order to adjust the chemical composition and structure of resultant borehole walls. As discussed above, the rate at which the gyrotron/waveguide assemblies is lowered can be controlled by using the sensors of step S606 so as to keep the distance between the bottom of the waveguide and the bottom of the borehole constant—or at least within a specified distance range. Next, at step S610, at some portion of a vertical stroke of the vertically-moveable platform, the vertically-moveable platform is temporarily paused (or slowed) and/or gyrotron energy is increased to create an indentation in the borehole walls (which may be created by plasma formation), such as the indentations shown in FIG. 2. Control continues to step S612.

In step S612, after a waveguide connector has descended below the lower clamps, the lower clamps are engaged, which as discussed above will allow the waveguide to continue to descend until the next connector above the lower clamps makes contact. In step S620 (FIG. 6B) at the bottom of a stroke of the drilling system (i.e., a length of waveguide section and/or the point where the next connector engages the lower clamps), the gyrotron is turned off and the additives are discontinued. Control continues to step S622.

In step S622, the waveguide portion whose connector is in contact with the lower clamps is decoupled from the gyrotron platform, and in S624 the upper clamps are disengaged. Then, at S626 the gyrotron platform is raised. Control continues to step S628.

In step S628, the gyrotron is repositioned atop of the platform so as to facilitate the addition of a new waveguide section, and in step S630 sensors may be used to determine the available heat energy/power that is available at the bottom of the borehole. Control jumps back to step S602 where steps S602-S630 may be repeated as desired.

FIGS. 7-9 depict mechanical details of an exemplary platform system useful for drilling. As shown in FIG. 7, the platform system (elevation view) includes a base 710, a moveable platform 712 and a fixed platform 714. Cylindrical columns 720—a total of eight in all in this embodiment (but can vary in other embodiments)—are used to give structure to the platform system and keep the base 710, moveable platform 712 and fixed platform 714 vertically aligned. Hydraulic pistons 730—again eight in all in this embodiment—are used to enable platform 712 to move vertically with respect to the base 710. A crane 740 rests atop the fixed platform so as to allow waveguide sections and pressure vessel sections to be loaded, offloaded and placed into position. A piping system 750 allows vaporized/pressured rock to be suctioned/blown from a borehole, passed through a filter (not shown), and allow recycled nitrogen to pass to a compressor, such as the pressure device 170 of FIG. IA. The example piping system 750 is constructed of interlocking pipe segments similar to a trombone to allow extension and contraction as the platform 712 raises and lowers.

As shown in FIG. 8, the moveable base platform 712 (plan view) is "I" shaped. Structures 720-1 are bolted to the columns 720 of FIG. 7. The hydraulic pistons 730 of FIG. 7 are bolted to the moveable platform 712 and the base platform. Weights 810 are distributed throughout the base platform to give it stability. Optional mechanical leveling devices 830 may be incorporated into the moveable platform to provide fine leveling. Such leveling devices 830 can take the form of short-stroke hydraulic pistons controllable so as to maintain fine leveling control.

FIG. 9 depicts a closer view of the center of the moveable platform 712. Holes 720-1 are depicted along with roller bearings 920, which are used to engage columns 720. A clamping system 910 is used to secure lengths of waveguide.

FIG. 10 depicts details of manufacturing a waveguide section. As shown at the top of FIG. 10 a collection of segments 154-S (typically 1 to 3 feet in length, for example) is shown with each segment 154-S precisely machined to accommodate millimeter-wave energy. Such machining may include, for example, parallel circular groves spaced at regular intervals, one or more spiral grooves or any other known or later-recognized groove pattern useful for the transmission of millimeter-wave energy with low losses.

Continuing to the middle portion of FIG. 10, the individual segments are assembled together to form a waveguide section with connectors (not shown) at each end. Then, (see bottom of FIG. 10), the assembled waveguide is wrapped in carbon fiber and/or any other number of suitable fibers where after the assembly is baked at a high temperature.

FIG. 11 is a flowchart outlining manufacturing steps for a waveguide section. While the various operations are depicted as a sequence, it is to be appreciated that some of the operations may occur in a simultaneous or in an overlapping fashion. Similarly, the order of various operations may be varied. Such variances from the flowchart structure of FIG. 11 will be apparent to those skilled in the various arts. The process starts in S1102 where individual waveguide segments are manufactured and (optionally) tested. For example, a length of copper tube between one foot and three feet in length can be machined so as to incorporate periodically-spaced grooves in the interior of the tube with the shape, depth and distance between grooves being a function of gyrotron energy wavelength(s). Spiral groves may be used as an alternative to concentric rings.

In S1104, individual waveguide segments are placed on a mandrel to form a waveguide section, and in S1106 pressure is placed on waveguide segments to both hold them securely as well as assure that segment ends are flush with one another. Then, in S1108, the spacing between grooves for the entire waveguide section is tested.

In S1110, the outside of the waveguide section is treated such that carbon fibers and resins will better adhere to it. For example, a waveguide section may be treated such that its outside will have a rough finish and/or scoring/grooves.

In S1113, the outside of the waveguide section is then wrapped in (sheets and/or individual threads of) carbon fibers (or some viable substitute) along with an appropriate resin (e.g., an epoxy resin), where after the resin is allowed to cure. Then, in S1114, the waveguide section is baked at a sufficiently-high temperature so as to allow any necessary outgassing and material stabilization.

While the invention has been described in conjunction with the specific embodiments thereof that are proposed as examples, it is evident that many alternatives, modifications, and variations will be apparent to those skilled in the art. Accordingly, embodiments of the invention as set forth herein are intended to be illustrative, not limiting. There are changes that may be made without departing from the scope of the invention.

What is claimed is:

1. A system for drilling, comprising:

a vertically-moving platform supporting an energy device capable of providing directed energy and capable of transmitting electromagnetic energy down a waveguide such that, as the vertically-moving platform moves downward, energy transmitted by the energy device through the waveguide will progressively drill a borehole in the earth as an appreciable constant distance is maintained between a bottom of the waveguide and a melt at the bottom of the borehole, wherein the waveguide includes a plurality of waveguide sections capable of being attached to one another;

an additive device that provides one or more additives to the borehole, and wherein each waveguide section includes: (1) an inner portion that conveys energy from the device to the bottom of the borehole; and (2) an interstitial portion configured to convey additive particles so as to enable the additive particles to mix with rock liquefied at the sides of the borehole; and a chemical composition detector that detects a chemical composition of rock vaporized by the directed energy, wherein the additive device adjusts additive types based on information provided by the detector.

2. The system of claim 1, wherein the vertically-moving platform and/or the energy device are configured to change output power and/or descent rate so as to create periodic indentations in the borehole.

3. The system of claim 1, further comprising one or more sensors capable of measuring the distance between the bottom of the waveguide and the melt at the bottom of the borehole, and the vertically-moving platform is controlled so as to provide a substantially constant distance between the bottom of the waveguide and the melt at the bottom of the borehole using information provided by the one or more sensors.

4. The system of claim 1, further comprising: a pressure device configured to produce substantially-pure nitrogen gas, and deliver the nitrogen gas to the borehole, wherein the pressure device is configured to produce nitrogen gas at pressures sufficient enough to balance litho-static pressure exerted on the borehole by surrounding rock at depths that exceed at least 15,000 feet.

5. The system of claim 1, further comprising: a pressure and flow valve that controls nitrogen gas pressure.

6. The system of claim 1, wherein the vertically-moving platform and/or the energy device are configured to change output power and/or descent rate so as to create periodic indentations in the borehole.

7. A method for drilling, comprising a downwardly-moving energy device capable of transmitted electromagnetic energy down a waveguide such that, as the energy device moves downward, energy transmitted by the energy device through the waveguide progressively drills a borehole in the earth while maintaining a distance between a bottom of the waveguide and a melt at the bottom of the borehole; and detecting a chemical composition of rock vaporized by energy device, and adjusting additive types based on the detected chemical composition of the vaporized rock.

8. The method of claim 7, wherein the waveguide includes a plurality of waveguide sections capable of being attached to one another.

9. The method of claim 7, further comprising conveying additive particles down the borehole using an interstitial portion of the waveguide so as to enable the additive particles to mix with rock liquefied at the sides of the borehole.

10. The method of claim 7, wherein the waveguide includes: (1) an inner portion that conveys energy from the energy device to the bottom of the borehole; and (2) an interstitial portion configured to convey additive particles to enable the additive particles to mix with rock liquefied at the sides of the borehole.

11. The method of claim 9, wherein the additive particles include glass-forming particles and at least one form of reinforcing fiber.

12. The method of claim 7, further comprising periodically changing at least one of the energy device's descent rate and the energy device's energy output so as to create periodic indentations in the borehole.

13. The method of claim 7, further comprising:

determining a distance from a melt area at the bottom of the borehole from the bottom end of the waveguide during drilling, and using the determined distance to maintain the distance between the waveguide and the melt area as a depth of the borehole increases.

14. The method of claim 13, wherein determining a distance from a melt area at the bottom of the borehole includes sending an electromagnetic wave down the interior of the waveguide.

15. The method of claim 7, further comprising producing substantially-pure nitrogen gas, and delivering the nitrogen gas to the borehole at pressures sufficient enough to balance litho-static pressure exerted on the borehole by surrounding rock at depths that exceed at least 15,000 feet.

16. The method of claim 15, wherein nitrogen gas pressure is controlled using a pressure and flow valve.

* * * * *